US009103561B2

(12) United States Patent
Chandler

(10) Patent No.: US 9,103,561 B2
(45) **Date of Patent: *Aug. 11, 2015**

(54) FRAC WATER HEATING SYSTEM AND METHOD FOR HYDRAULICALLY FRACTURING A WELL

(71) Applicant: Ronald L. Chandler, Wichita Falls, TX (US)

(72) Inventor: Ronald L. Chandler, Wichita Falls, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/169,761

(22) Filed: Jan. 31, 2014

(65) Prior Publication Data

US 2014/0144394 A1 May 29, 2014

Related U.S. Application Data

(60) Continuation-in-part of application No. 13/897,883, filed on May 20, 2013, which is a division of application No. 12/352,505, filed on Jan. 12, 2009, now Pat. No. 8,534,235.

(60) Provisional application No. 61/078,734, filed on Jul. 7, 2008.

(51) Int. Cl.

| | |
|---|---|
| ***F24H 1/06*** | (2006.01) |
| ***E21B 43/26*** | (2006.01) |
| ***F24H 1/08*** | (2006.01) |
| ***F24H 1/40*** | (2006.01) |
| ***F24H 9/20*** | (2006.01) |
| ***F24H 1/43*** | (2006.01) |

(Continued)

(52) U.S. Cl.

CPC *F24H 1/06* (2013.01); *E21B 43/26* (2013.01); *F24H 1/08* (2013.01); *F24H 1/40* (2013.01); *F24H 1/43* (2013.01); *F24H 9/2035* (2013.01); *F28D 7/0066* (2013.01); *F28D 7/02* (2013.01); *F28D 7/08* (2013.01); *F28F 9/26* (2013.01)

(58) Field of Classification Search

CPC ..... F24H 1/06; F24H 1/08; F24H 9/2035; F28D 7/06; F28D 7/08; F28D 7/163

USPC ..... 122/14.2, 17.2, 18.4, 250 R, DIG. 10

See application file for complete search history.

(56) References Cited

U.S. PATENT DOCUMENTS

| | | | |
|---|---|---|---|
| 2,018,037 | A | 10/1935 | Sieder |
| 2,303,613 | A | 12/1942 | Charlton |

(Continued)

*Primary Examiner* — Alissa Tompkins
*Assistant Examiner* — Nathaniel Herzfeld
(74) *Attorney, Agent, or Firm* — Jeffrey G. Degenfelder; Carstens & Cahoon, LLP

(57) ABSTRACT

The present invention provides an improved frac water heating system to fracture a subterranean formation at a remote work site to produce oil and gas. The present invention includes a single-pass tubular coil heat exchanger contained within a closed-bottom firebox having a forced-air combustion and cooling system to heat the treatment fluid. In another embodiment, the invention includes multiple, single-pass heat exchanger units arranged in a vertically stacked configuration to heat the treatment fluid. In a preferred embodiment, the improved frac water heating system is used to heat water on-the-fly (i.e., directly from the supply source to the well head) to complete hydraulic fracturing operations. The present invention also includes systems for regulating and adjusting the fuel/air mixture within the firebox to maximize the combustion efficiency. The system may also include a novel hood opening mechanism attached to the exhaust stack of the firebox.

20 Claims, 23 Drawing Sheets

(51) Int. Cl.

| | |
|---|---|
| *F28D 7/00* | (2006.01) |
| *F28D 7/02* | (2006.01) |
| *F28D 7/08* | (2006.01) |
| *F28F 9/26* | (2006.01) |

(56) References Cited

U.S. PATENT DOCUMENTS

| | | | | | |
|---|---|---|---|---|---|
| 2,714,139 | A | | 7/1955 | Yula | |
| 2,813,583 | A | | 11/1957 | Marx et al. | |
| 2,976,918 | A | | 3/1961 | Leach | |
| 3,106,915 | A | * | 10/1963 | Key, Jr. | 126/343.5 A |
| 3,401,673 | A | * | 9/1968 | Key, Jr. | 122/250 R |
| 4,174,951 | A | * | 11/1979 | Bloom | 432/133 |
| 4,261,795 | A | * | 4/1981 | Reilly | 202/118 |
| 4,411,133 | A | | 10/1983 | Stearns et al. | |
| 4,715,808 | A | * | 12/1987 | Heath et al. | 431/18 |
| 5,441,605 | A | * | 8/1995 | Beasley et al. | 202/176 |
| 5,638,773 | A | * | 6/1997 | Brady et al. | 122/248 |
| 5,979,549 | A | | 11/1999 | Meeks | |
| 6,129,148 | A | * | 10/2000 | Meeks | 166/263 |
| 6,206,091 | B1 | | 3/2001 | Buehler | |
| 7,111,687 | B2 | | 9/2006 | Donald et al. | |
| 7,261,088 | B2 | | 8/2007 | Ciampolini | |
| 7,614,367 | B1 | * | 11/2009 | Frick | 122/26 |
| 8,171,993 | B2 | | 5/2012 | Hefley | |
| 2001/0018962 | A1 | | 9/2001 | Joshi et al. | |
| 2006/0060418 | A1 | * | 3/2006 | de Borchgrave et al. | 181/229 |
| 2006/0260331 | A1 | | 11/2006 | Andreychuk | |
| 2006/0266305 | A1 | * | 11/2006 | Zorzit | 122/18.1 |
| 2014/0144393 | A1 | * | 5/2014 | Chandler | 122/14.2 |

* cited by examiner

FRAC WATER HEATING SYSTEM AND METHOD FOR HYDRAULICALLY FRACTURING A WELL

CROSS-REFERENCE TO RELATED APPLICATION

This application is a continuation-in-part application of U.S. application Ser. No. 13/897,883 filed May 20, 2013, which is a divisional application of U.S. application Ser. No. 12/352,505 (now U.S. Pat. No. 8,534,235) filed Jan. 12, 2009, which claims the benefit of and priority to a U.S. Provisional Patent Application No. 61/078,734 filed Jul. 7, 2008, the technical disclosure of which is hereby incorporated herein by reference.

This application is related to the following copending U.S. Patent Applications, which are incorporated by reference herein in their entirety:

U.S. patent application Ser. No. 14/169690, "Frac Water Heating System and Method for Hydraulically Fracturing a Well," filed Jan. 31, 2014.

U.S. patent application Ser. No. 14/169823, "Frac Water Heating System and Method for Hydraulically Fracturing a Well," filed Jan. 31, 2014.

BACRGROUND OF THE INVENTION

1. Technical Field

The present invention relates to apparatus and methods for heating a water or petroleum based fluid for injection into an oil or gas well or into a pipeline system.

2. Description of the Related Art

It is common in the oil and gas industry to treat oil and gas wells and pipelines with heated fluids such as water and oil. For example, one such application commonly known as a hydraulic fracturing job or "frac" job, involves injecting large quantities of a heated aqueous solution into a subterranean formation to hydraulically fracture it. Such frac jobs are typically used to initiate production in low-permeability reservoirs and/or re-stimulate production in older producing wells. Water is typically heated to a specific temperature range to prevent expansion or contraction of the downhole well casing. The heated water is typically combined with a mixture of chemical additives (e.g., friction reducer polymers which reduce the viscosity of the water and improve its flowability so that it's easier to pump down the well), proppants (e.g., a special grade of light sand), and a cross-linked guar gel that helps to carry the sand down into the well. This fracking fluid is then injected into a well hole at a high flow rate and pressure to break up the formation, increasing the permeability of the rock and helping the gas or oil flow toward the surface. As the fracking solution cracks the rock formation, it deposits the sand. As the fractures try to close, the sand keeps them propped open. Frac jobs are typically performed once when a well is newly drilled, and again after a couple of years when the production flow rate begins to decline.

Another application, commonly referred to as a "hot oil treatment", involves treating tubulars of an oil and gas well or pipeline by flushing them with a heated solution to remove build up of paraffin along the tubulars that precipitate from the oil stream that is normally pumped therethrough.

Frac jobs and hot oil treatments are typically performed at the remote well sites and usually require less than a week to complete. Consequently, the construction of a permanent heating facility at the well site is not cost effective. Instead, portable heat exchangers, which are capable of transport to remote well sites via improved and unimproved roads, are commonly used.

In the past, such portable heat exchangers have typically employed gas-fired heat sources using a liquefied petroleum gas (LPG) such as propane to heat treatment fluids at remote well sites. Such gas-fired heater units typically include a tubular coil heat exchanger configured above one or more ambient aspirated open-flame gas burners in an open-ended firebox housing. The tubular coil heat exchanger typically comprises a fluid inlet in communication with a plurality of interconnected tubes, which in turn communicate with a fluid outlet. The plurality of tubes is typically arranged in a stacked configuration of planar rows, wherein each tube in a row is aligned in parallel with the other tubes. The outlet of each tube is connected in series to the inlet of an adjacent tube in the row by means of a curved tube or return bend. Similarly, each planar row is connected to the adjacent rows above and below by connecting the outlet of the outermost tube in one row with the inlet of the outermost tube in another row by means of a curved tube or return bend.

The one or more gas burners are typically positioned below the tubular coil heat exchanger so as to project a vertical flame up and through the heat exchanger. The gas burners are supplied with gas fuel from a nearby gas storage tank (e.g., a propane tank). Ambient air is also supplied to the burners via the opened-ended bottom of the firebox housing. The hot flue gasses generated from the burning of the LPG rise up and through the tubular coil heat exchanger within the firebox housing and exhaust via a vent at the top of the firebox housing.

While such conventional gas-fired heat sources are adequate for performing many oil field servicing tasks, they exhibit a number of inherent drawbacks. These inherent limitations significantly impact their effectiveness in performing certain heating operations at remote oil field work sites. For example, frac jobs typically require the production of massive volumes of heated water. While conventional gas-fired heat sources are certainly capable of heating fluids such as water, they are poorly suited to heating in a timely manner large volumes of continuously flowing water in many commonly occurring climactic and atmospheric conditions. Moreover, the logistics involved in conducting such heating operations at remote work sites negatively impacts the cost efficiencies of such a system.

For example, LPG (e.g., propane gas) has a relatively low energy content and density when compared to other fuel options. For example, diesel fuel when properly combusted typically releases about 138,700 British thermal units (BTU) per US gallon, while propane typically releases only about 91,600 BTU per liquid gallon, or over 33% less. Thus, conventional gas-fired heating units often lack sufficient heating capacity to produce sufficient quantities of heated water rapidly enough for the required operation to be completed. Consequently, in order to provide sufficient quantities of heated water on a timely basis for a typical frac job, the treatment water must often be preheated and stockpiled in numerous frac water holding tanks These holding tanks range in size up to 500 bbl. (i.e., approximately 21,000 gallons). It is not unusual for a typical frac job to require 10 or even 20 frac water holding tanks at the remote work site. The preheated water is typically overheated so as to allow for cooling while waiting to be injected into the well. Oftentimes, the preheated treatment water must be reheated just prior to injection into the well head. Needless to say, the logistics involved with providing additional holding tanks at the remote work site and the additional costs incurred in overheating or reheating the supply water negatively impacts the efficiency of the overall operation.

While the technique of overheating and stockpiling supply water can ameliorate some of the shortcomings in the heating capacity of conventional gas-fired heat sources, in certain circumstances (e.g., severely cold weather or high altitude) it is inadequate. This is due to a number of reasons. First, the temperature change requirement for the system is simply greater in colder weather. That is, in colder weather the intake water supplied to the gas-fired heating unit is colder while the required injection temperature remains essentially the same. Thus, it takes longer for the conventional gas-fired heating unit to preheat the supply water. The problem is further compounded by the fact that the stockpiled preheated water cools more rapidly in colder weather. Moreover, at higher altitudes there is less oxygen in the ambient atmosphere for combustion in a conventional, naturally aspirated gas burner. Thus, at higher altitudes the heating capacity of conventional gas-fired heat sources is further reduced.

In addition, propane gas requires large and heavy high-pressure fuel tanks for its transport to remote sites. The size of such high-pressure fuel tanks is, of course, limited by the size of existing roads. Thus, a typical frac job may require the transport of multiple large high-pressure fuel tanks to a remote site to ensure an adequate supply of fuel to complete the operation.

Furthermore, there are several safety concerns which must be taken into consideration when using conventional gas-fired heat sources. As mentioned previously, current gas-fired heat exchangers typically use a naturally aspirated, open flame burner (i.e., a burner which is open to the ambient atmosphere). The fire boxes of such heat exchangers are typically elevated above the ground and opened on the bottom. The gas-fired burners are typically positioned near the open bottom of the firebox and directly below the heat exchange tubing. These conventional gas-fired burners draw ambient air as necessary to assist in the combustion of the propane gas. While simple and efficient in providing air for combustion, open flame burners present a number of safety concerns. An open flame at the well site poses a substantial risk of explosion and uncontrolled fire, which can destroy the investment in the rig and injure or even cost the lives of the well operators. Moreover, open flame burners are particularly susceptible to erratic burning or complete blow-out in gusty wind conditions. Current U.S. government safety regulations provide that the open flame heating of the treatment fluids cannot take place within the immediate vicinity of the well.

While safety concerns are of overriding importance, compliance with the no open-flame regulations requires additional time and expense to conduct heated fluid well treatments. Thus, there has been a long felt need for safer and more efficient apparatus and methods of heating treatment fluid for injecting into the tubulars of oil and gas wells and pipelines without using an open flame heat source in the vicinity of the treatment location.

SUMMARY OF THE INVENTION

The present invention overcomes many of the disadvantages of prior art mobile oil field heat exchange systems by providing a self-contained, frac-water heating system that is capable of safely and continuously heating large quantities of treatment fluids at remote locations in severely cold weather or at high altitude. In one embodiment, the present invention is disposed on a trailer rig and includes a closed-bottom firebox having a forced-air combustion and cooling system. The rig also includes integral fuel tanks, hydraulic and pneumatic systems for operating the rig at remote operations in all-weather environments. In a preferred embodiment, the frac-water heating system is used to heat treatment fluid on-the-fly (i.e., directly from the supply source to the well head) to complete hydraulic fracturing operations.

The present invention comprises a closed firebox that includes a novel heat exchanger comprised of one or more single-pass tubular coils configured in a highly oscillating or serpentine manner and oriented along multiple axes so as to maximize its exposure to the heat generated by the burner assemblies. The design of the heat exchanger includes a horizontal tunnel configured within a bottom portion. The burner assemblies are configured and oriented in relation to the tunnel so that their flames are initially generated in a horizontal fashion into the tunnel within the heat exchanger. In one embodiment, the burner assemblies comprise oil-fired burner assemblies which combust fuel oil. In another embodiment, the burner assemblies comprise gas-fired burner assemblies, which combust a liquefied petroleum gas (LPG) such as propane.

The present invention further includes a novel forced-air combustion and cooling system. The forced-air system is comprised of a primary air system and a secondary air system. The primary air system provides pressurized air directly to the burner assemblies to maximize atomization and combustion of the fuel. The secondary air system provides pressurized air to strategic positions within the firebox to assist in controlling the cooling of the firebox and to maximize the combustion of the fuel/air mixture. In addition, vents and vent passageways are formed in the wall of the firebox and supply supplemental ambient air to the front of the burner assemblies. The vents allow the system to be operated more safely by allowing burner access doors to be configured in a "down" or "closed" position during operations, which significantly reduces the operational noise created by burner assemblies when operating. Moreover, with the burner access doors configured in the "down" position, the danger inherent in a blowback event of the burner assemblies is greatly reduced. The primary and secondary air systems are powered by hydraulic pumps integral to the overall system. The present invention also includes systems for regulating and adjusting the fuel/air mixture within the firebox to maximize the combustion efficiency.

The improved system of the present invention also includes several subsystems for maximizing the safety and efficiency of the heat exchanger system. The system includes a novel hood mechanism attached to the exhaust stack of the firebox. In addition, the system includes a novel intake air muffler/silencer system, which significantly reduces the noise generated by the intake of such large quantities of ambient air.

The system also includes novel methods for heating large volumes of treatment fluids, such as water, in a continuously flowing fashion so that heating operations can be performed "on-the-fly", i.e., without the use of preheated stockpiles of treatment fluid. For example, water at ambient temperature conditions can be drawn into the device of the present invention and heated so that sufficient volumes of continuously flowing heated treatment fluid may be supplied directly to the well head for conducting hydraulic fracturing operations on the well. The system also includes novel methods for controlling the heating of the treatment fluid as it passes through the system. The system further includes novel methods for controlling the temperature change and volume flow of treatment fluid as it passes through the system. The novel methods include using two or more frac water heating systems in a parallel configuration to increase the continuous flowrate of treatment fluid to the well head. Alternatively, the novel methods include using two or more frac water heating systems in a tandem configuration to increase the differential in temperature of the treatment fluid from the ambient source to the wellhead.

BRIEF DESCRIPTION OF THE DRAWINGS

A more complete understanding of the method and apparatus of the present invention may be had by reference to the following detailed description when taken in conjunction with the accompanying drawings, wherein.

Figure 1A:
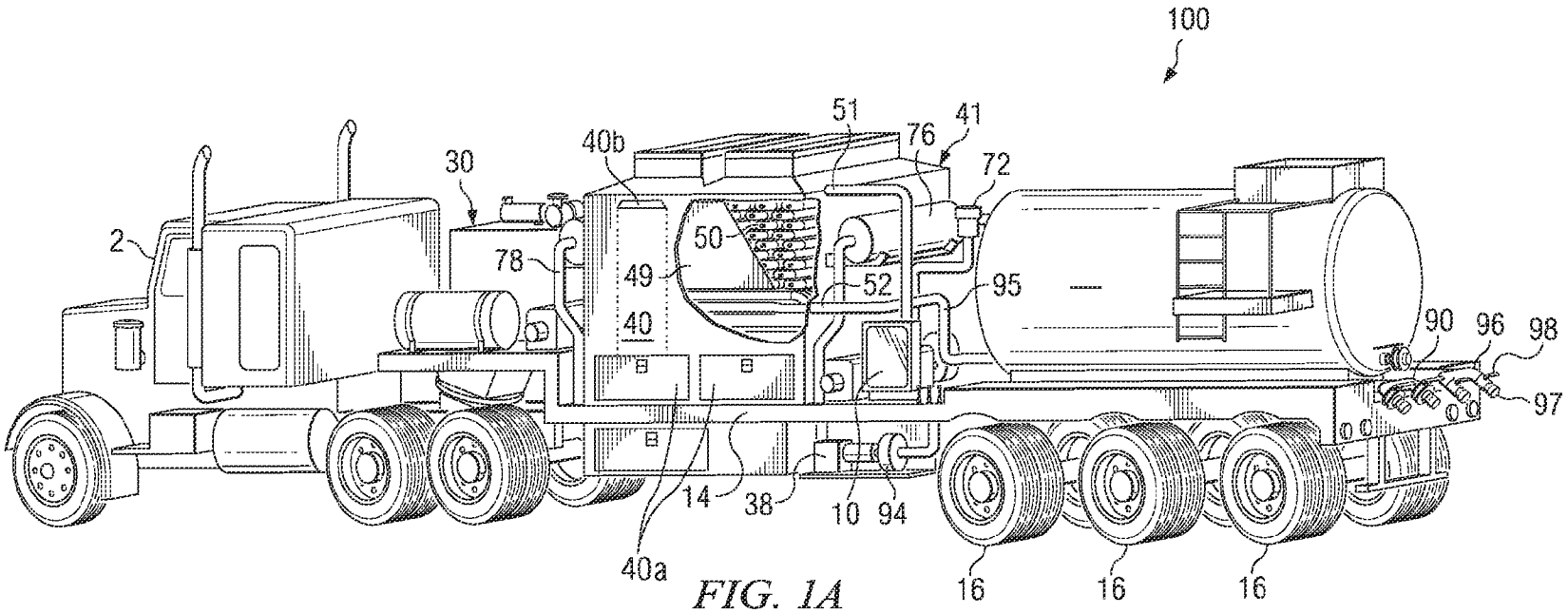
FIG. 1A is a perspective view of an embodiment of the Frac Water Heating System of the present invention.

Where used in the various figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

DETAILED DESCRIPTION OF THE INVENTION

With reference to the Figures, and in particular to FIGS. 1A, 2A-C, and 5, a first embodiment of the improved frac water heating system 100 of the present invention is shown. The first embodiment 100 shown in the referenced Figures can be configured with either an oil-fired or a gas-fired heating system. As depicted, the first embodiment of the frac water heating system 100 is configured on a drop deck trailer 14 and suitable for transport to remote oil field sites. The system 100 includes a fuel storage and supply system, a firebox 40 containing a single heat exchanger 50, primary 70 and secondary 80 air supply systems connected to the firebox 40, and an auxiliary power plant 30 for driving an accessory gearbox 32. The accessory gearbox 32, in turn, drives multiple hydraulic pumps, which power a main fluid pump 94 and the air supply systems. The main fluid pump 94 is used to draw treatment fluid, such as water, from a fluid source and supply it to the intake 51 of the heat exchanger 50. The hydraulic pressure generated by the main fluid pump 94 effectively pumps the treatment fluid through the heat exchanger 50 where it is heated. As the treatment fluid proceeds through a single pass of the heat exchanger 50 it increases in temperature until it reaches an outlet 52 of the heat exchanger 50 where it is directed via tubular conduits or hose to the well head for injection into the formation. The system 100 also includes a control quadrant 10 and control levers 12 for operating and monitoring the system 100.

With reference to the Figures, and in particular to FIGS. 1B, 2C-E, 4C-D and 5, a second alternative embodiment of the improved frac water heating system 100A of the present invention is shown. The second embodiment 100A shown in the referenced Figures can be configured with either an oil-fired or a gas-fired heating system. As depicted, the second embodiment of the frac water heating system 100A is configured on a drop deck trailer 14 and suitable for transport to remote oil field sites. The system 100A includes fuel storage and supply system, a firebox 40 containing a heat exchanger device 50A having two or more single-pass heat exchanger units arranged in a stacked configuration, primary 70 and secondary 80 air supply systems connected to the firebox 40, and an auxiliary power plant 30 for driving an accessory gearbox 32. The accessory gearbox 32, in turn, drives multiple hydraulic pumps, which power a main fluid pump 94 and the air supply systems. The main fluid pump 94 is used to draw treatment fluid, such as water, from a fluid source and supply it to the multiple inlets 51A-C of the a heat exchanger device 50A having two or more single-pass heat exchanger units arranged in a stacked configuration. The hydraulic pressure generated by the main fluid pump 94 effectively pumps the treatment fluid through the heat exchanger device 50A where it is heated. As the treatment fluid proceeds through a single pass of its respective heat exchanger unit, its temperature increases until it reaches the outlet 52A-C of its respective heat exchanger unit 56A, 53A, 53B where it is collected and directed via tubular conduits or hose to the well head for injection into the formation. The system 100A also includes a control quadrant 10 and control levers 12 for operating and monitoring the system 100A.

Figure 1B:
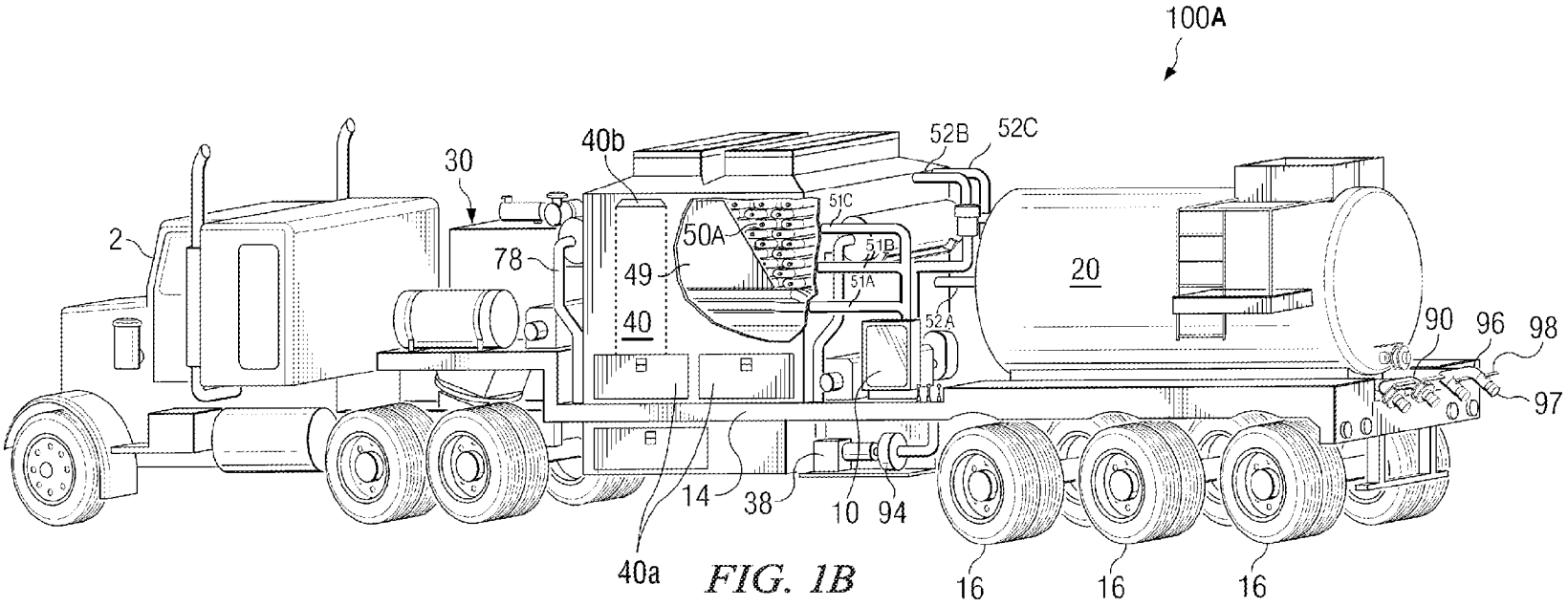
FIG. 1B is a perspective view of an alternate embodiment of the Frac Water Heating System of the present invention.

As shown in the embodiments depicted in the FIGS. 1A and 1B, the entire frac water heating system of the present invention may be configured on a single drop deck trailer 14 having multiple wheels 16 and connected to a separate towing vehicle 2. It is understood that alternate embodiments of the system of the present invention may be skid mounted or configured integral to a single vehicle. In addition, the subject invention may also be configured so that one or more of the various components of the system (e.g., fuel tank 20, firebox 40, and auxiliary power plant 30) are configured on separate trailers, vehicles or skids for transport to the remote work site.

With reference again to the Figures, and in particular to FIGS. 2A-2E and 3A-B, the first and second embodiments of the improved frac water heating system 100, 100A of the present invention include several common components. The components of the embodiments of the improved frac water heating system 100, 100A of the present invention will now be described in greater detail. As depicted in the Figures, each of the embodiments of the present invention 100, 100A is disposed on a single trailer rig 14 and includes a firebox 40 containing a heat exchanger device, primary 70 and secondary 80 air supply systems connected to the firebox 40, a fuel system for storing and supplying fuel to multiple burner assemblies 60 configured in the firebox 40, and an auxiliary power plant 30, which powers multiple hydraulic systems and assorted auxiliary systems. As shown in further detail in FIG. 4E, the firebox 40 may also include one or more vents 40*b* and passageway 40c which supplies ambient air from the upper exterior of the firebox 40 to the front of the burner assemblies 60. The vent 40*b* and passageway 40*c*enable the burner assemblies 60 to operate with the access door 40*a* configured in a "closed" position, which significantly reduces the operational noise created by burner assemblies 60 when operating. Moreover, with the burner access doors 40a configured in the "down" position (shown in FIG. 1A), the danger inherent in a blowback event of the burner assemblies 60 is greatly reduced.

Auxiliary Power Plant & Hydraulic System

As depicted in the Figures, the auxiliary power plant 30 is configured near the front end of the trailer 14. The auxiliary power plant 30 provides power for driving an accessory gearbox 32 and assorted auxiliary systems (e.g., electric, pneumatic). In one embodiment, the auxiliary power plant 30 comprises a diesel engine, which includes an electric alternator and air compressor. Alternatively, the electric alternator and air compressor may be powered by the accessory gearbox 32. The electric alternator provides electrical power to the system 100 and the pneumatic compressor provides pneumatic pressure for controlling the system 100.

The auxiliary power plant 30 provides the primary motive force for driving the accessory gearbox 32. The accessory gearbox 32, in turn, drives multiple hydraulic pumps that power the hydraulic systems of the present invention. Each hydraulic pump is used to power an independent hydraulic circuit. For example, in the depicted embodiment, the accessory gearbox 32 powers three hydraulic circuit systems. The first hydraulic circuit includes a first hydraulic pump 33 that supplies pressurized hydraulic fluid via supply/return line 33*a* to a first hydraulic motor 36, which powers the first air blower system. The second hydraulic circuit includes a second hydraulic pump 34 that supplies pressurized hydraulic fluid via supply/return line 34*a* to the second hydraulic motor 37, which powers the second air blower system. The third hydraulic circuit includes a third hydraulic pump 35 that supplies pressurized hydraulic fluid via supply/return line 35*a* to a third hydraulic motor 38, which powers the main fluid pump 94. The three hydraulic systems are supplied by a hydraulic reservoir 31 positioned near the accessory gearbox 32. In a preferred embodiment, the three hydraulic pumps 33, 34, 35 each comprise a mechanically-driven, variable-displacement, hydraulic pump; while the three hydraulic motors 36, 37, 38 each comprise fixed displacement hydraulic motors. The hydraulic pumps 33, 34, 35 are rated at 5000 psi, but typically operated at approximately 2500-3000 psi.

Treatment Fluid Supply System

The main fluid pump 94 is used to draw treatment fluid, such as water, from a fluid source and supply it to the inlet of the heat exchanger device. The main fluid pump 94 is typically integral to the system and has sufficient power to both draw the treatment fluid from a source and to pump the treatment fluid through the heat exchanger device and on to the well head for subsequent injection into the formation. In one embodiment, the main fluid pump 94 comprises a hydraulically-powered centrifugal fluid pump that is capable of supplying treatment fluid to the heat exchanger device at a pressure of about 150 psi. The volume of treatment fluid pumped through the heat exchanger device will vary with the pump speed and the configuration of the heat exchanger device. In a preferred embodiment, the main fluid pump 94 is capable of pumping a maximum of 252 gpm of treatment fluid through the heat exchanger device.

Figure 2A:
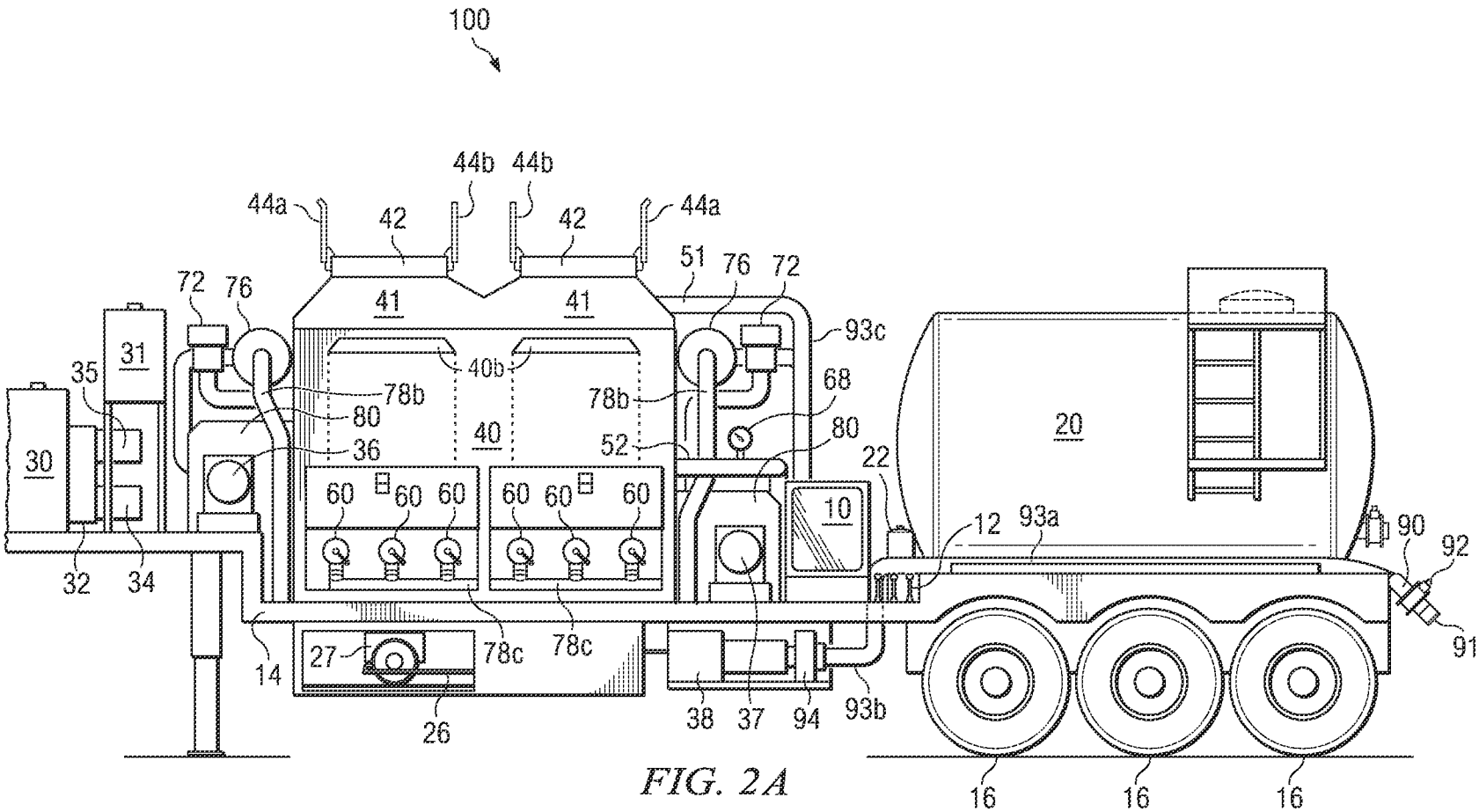
FIG. 2A is a left side elevation view of the embodiment of the Frac Water Heating System of the present invention shown in FIG. 1A.

As shown in the Figures, the fluid supply system may include an intake manifold 90 for connecting one or more supply hose (not shown) to the system's respective intake. The intake manifold 90 may include one or more spigots 91 for receiving supply hose in fluid communication with the fluid source. Each inlet spigot 91 may further include a valve mechanism 92, which selectively controls the fluid flow through its respective inlet spigot 91. Tubular intake conduits 93*a*, 93*b* fluidly connect the inlet of the main fluid pump 94 with the intake manifold 90. Inlet conduit 93*c* fluidly connects the outlet of the main fluid pump 94 with the inlet of the heat exchanger device. For example, as shown in FIG. 2A, inlet conduit 93*c* of the first embodiment of the improved frac water heating system 100 fluidly connects the outlet of the main fluid pump 94 to the single inlet 51 of the heat exchanger 50. In contrast, while conduit 93*c* of the second embodiment of the improved frac water heating system 100A (see FIG. 2B) includes an inlet that is fluidly connected to the outlet of the main fluid pump 94, it further includes multiple outlets which divide the fluid flow amongst the plurality of inlets 51A-C of the plurality of single-pass heat exchanger units. As will be explained in greater detail infra, by dividing the fluid flow amongst multiple inlets the flow capacity of a heat exchanger device is greatly enhanced while reducing internal pressures on the system.

The hydraulic pressure generated by the main fluid pump 94 effectively pumps the treatment fluid through the heat exchanger device where it is heated. As the treatment fluid proceeds through a single pass of the heat exchanger device it increases in temperature until it reaches an outlet of the heat exchanger device where it is directed via tubular outlet conduit 95 and supply hose (not shown) to the well head for injection into the formation.

Figure 2B:
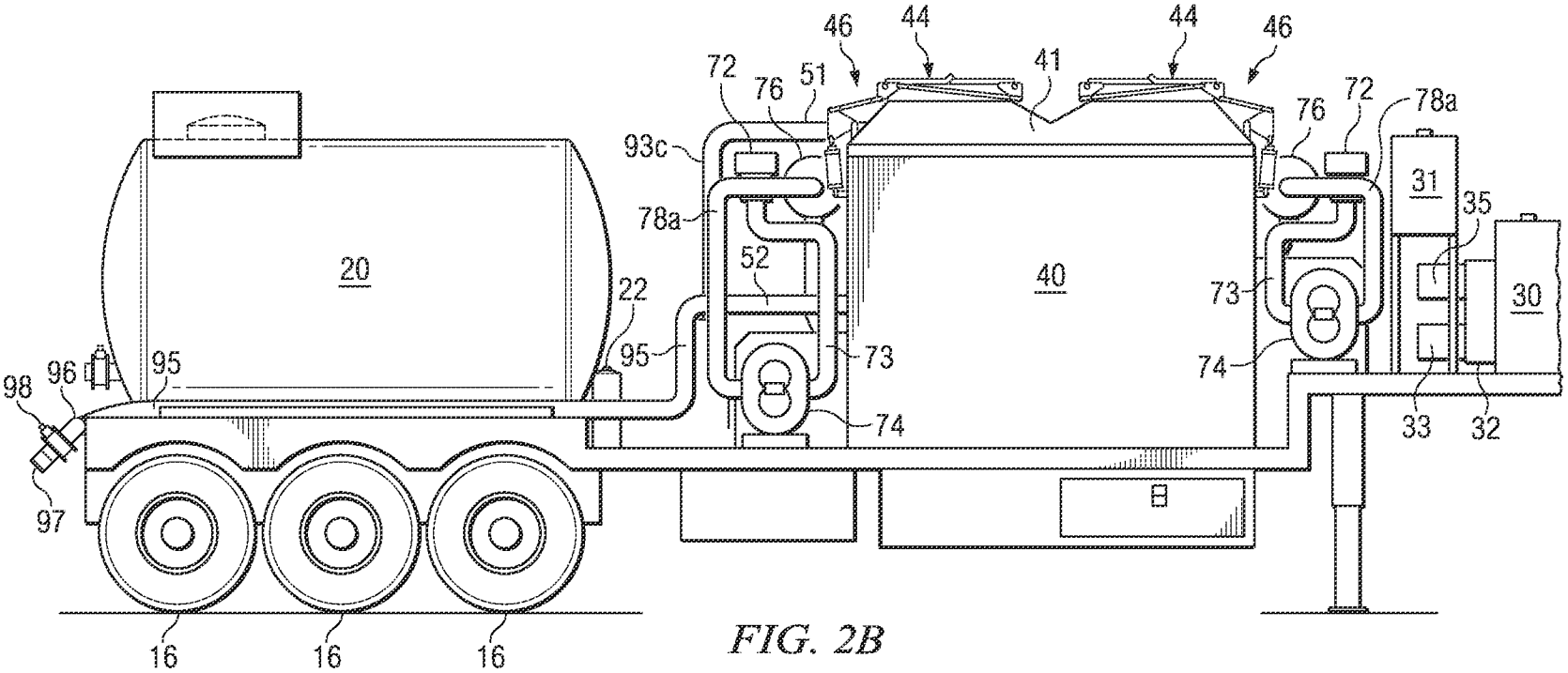
FIG. 2B is a right side elevation view of the embodiment of the Frac Water Heating System of the present invention shown in FIG. 1A.
Figure 2C:
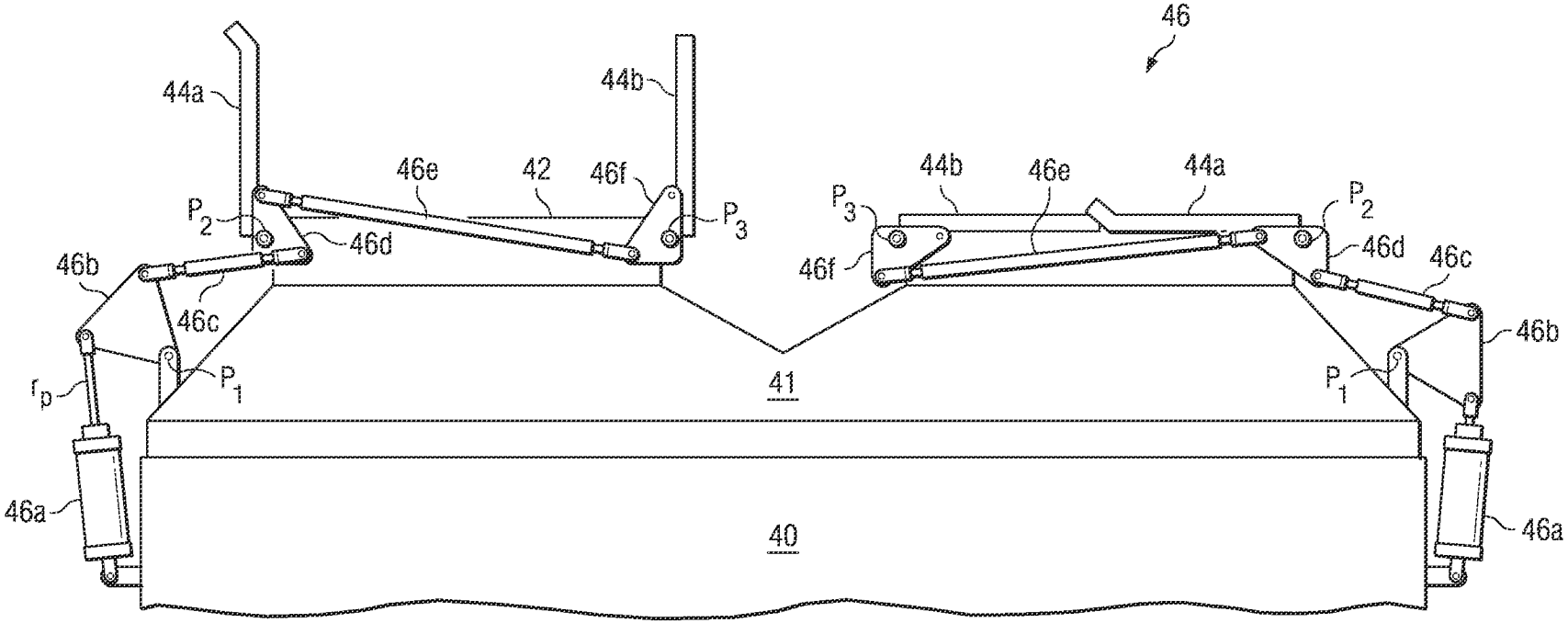
FIG. 2C is a close-up view of the mechanism for opening and closing the opposing hood doors of the embodiments of the Frac Water Heating System of the present invention shown in FIGS. 1A and 1B.

For example, as shown in FIG. 2B, in the first embodiment of the improved frac water heating system 100 the single outlet 52 of the heat exchanger 50 is fluidly connected to outlet conduit 95. In contrast, as shown in FIGS. 2E and 3B, in the second embodiment of the improved frac water heating system 100A the multiple outlets 52A-C of the plurality of single-pass heat exchanger units that are fluidly connected to a common outlet conduit 95.

As shown in the Figures, the fluid supply system may further include an outlet manifold 96 having one or more spigots 97 for connecting with supply hose. Each outlet spigot 97 may further include a valve mechanism 98, which selectively controls the fluid flow through its respective outlet spigot 97.

Fuel Supply & Control Systems

Figure 7A:
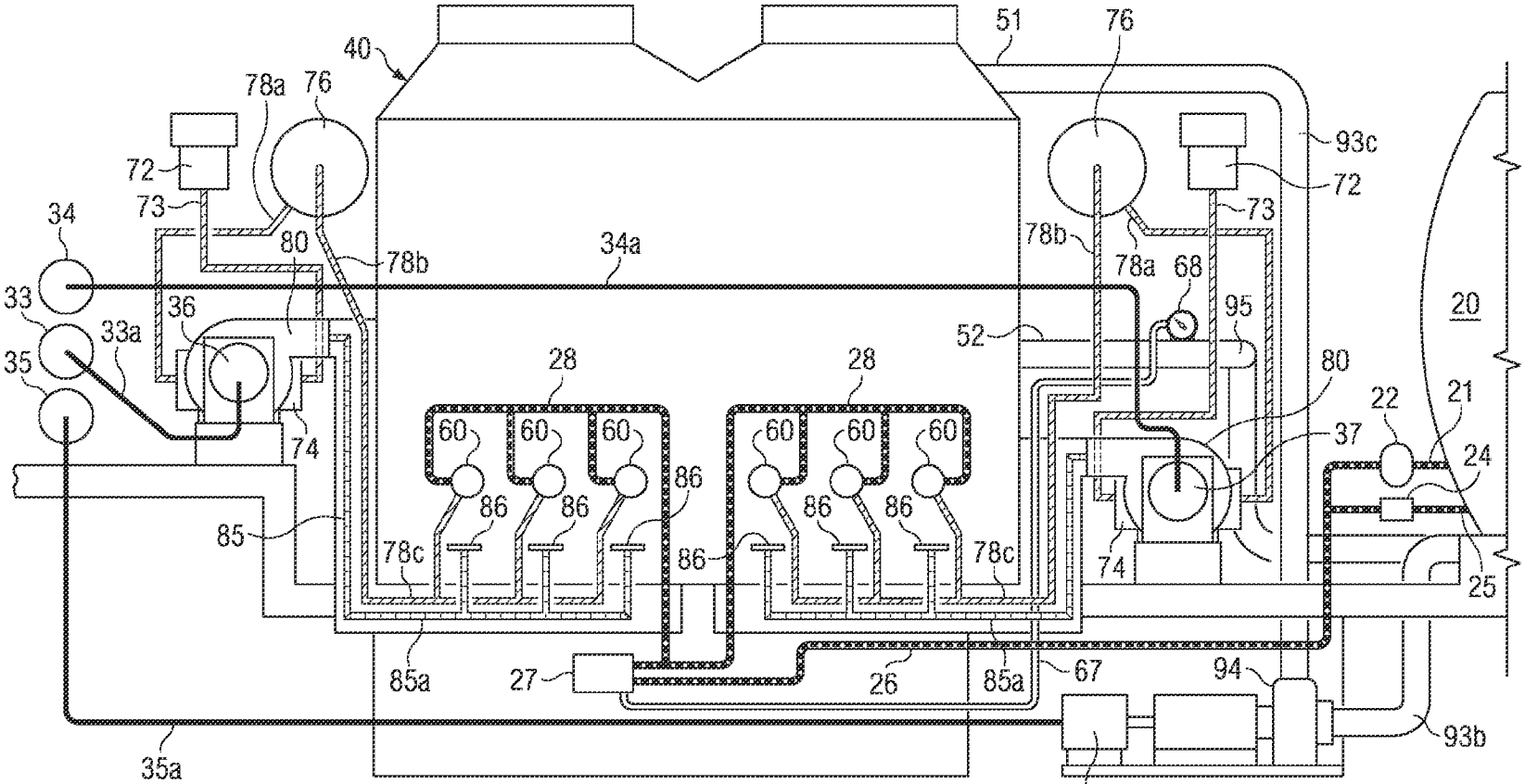
FIG. 7A is a schematic depiction of the hydraulic, fuel, and air supply systems of the embodiment of the Oil-Fired Frac Water Heating System of the present invention.
Figure 8A:
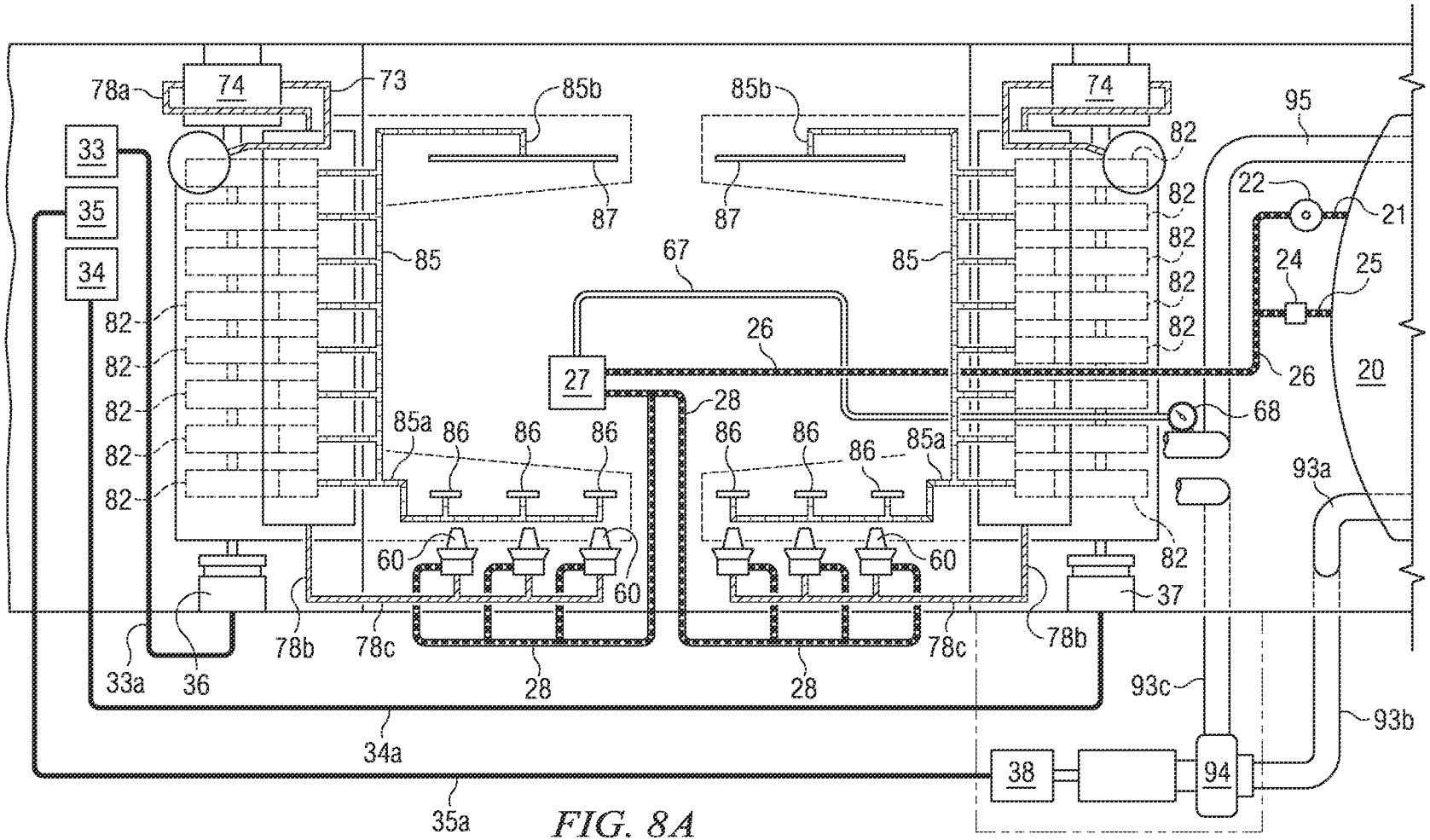
FIG. 8A is an overhead view of a schematic depiction of the hydraulic, fuel, and air supply systems of the embodiment of the Oil-Fired Frac Water Heating System of the present invention shown in FIG. 7A.

As shown in the Figures and schematically depicted in FIGS. 7A and 8A, in one embodiment the fuel system includes a fuel tank 20, which is configured near the rear or back end of the trailer 14. The fuel tank 20 is typically unpressurized and used to store the liquid fuel used by the multiple burner assemblies 60 configured in the firebox 40. In the depicted embodiment 100, the fuel tank 20 is unpressurized and can hold up to 60 bbl. of diesel fuel. The fuel system also includes an unpressurized fuel line 21, which supplies fuel from the fuel tank 20 to the intake of a fuel pump 22. The fuel pump 22 boosts the fuel pressure and directs it to the multiple burner assemblies 60 by means of a pressurized fuel line 26. In one embodiment, the fuel pump 22 boosts the fuel pressure to approximately 50-100 psi, preferably 60 psi.

The liquid fuel system also includes a pressure relief valve 24 in fluid communication with the pressurized fuel line 26. The pressure relief valve 24 permits fuel to vent back into the fuel tank by means of fuel line 25 when the fuel pressure in the pressurized fuel line 26 exceeds a certain pressure.

The fuel system further includes a fuel pressure control motor valve 27, which regulates the flow of fuel from the pressurized fuel line 26. The pressurized fuel line 26 fluidly connects the outlet of the fuel pump 22 with the inlet of a fuel pressure control motor valve 27. The fuel pressure control motor valve 27 controls the amount of fuel supplied to the multiple burner assemblies 60 via pressurized metered fuel lines 28. As depicted in the drawings, the metered fuel lines 28 may be configured so as to supply pressurized fuel to sets of burner assemblies, which are comprised of more than one burner assembly 60. The fuel pressure control motor valve 27 may be electrically, pneumatically or hydraulically actuated. In a preferred embodiment, the fuel pressure control motor valve 27 comprises a pneumatically-actuated flow control valve.

The temperature of the treatment fluid exiting the heat exchanger outlet 52 is a function of three variables: the volumetric flow rate of the treatment fluid through the heat exchanger 50; the flow rate of the pressurized secondary air; and the heat generated by the multiple burner assemblies 60 configured in the heat exchanger 50. The flow rate of the secondary air is typically held constant during all operations while the volumetric flow rate of the treatment fluid is typically constant for a given operation. Thus, the temperature of the treatment fluid exiting the heat exchanger outlet 52 is controlled by regulating the volume of fuel supplied to the multiple burner assemblies 60.

An adjustable temperature controller mechanism 68 is used to send a control signal, which causes the fuel pressure control motor valve 27 to open or close, thereby increasing or decreasing the volume of fuel supplied to the multiple burner assemblies 60 via pressurized metered fuel lines 28. The control signal may comprise an electrical, wireless, pneumatic, or hydraulic signal. For example, in one embodiment, the adjustable temperature controller mechanism 68 comprises a simple manual rotary or slider rheostat device, which controls an electric signal that controls the actuation of the fuel pressure control motor valve 27. In another embodiment, the adjustable temperature controller mechanism 68 comprises a simple manual rotary valve, which controls a pneumatic pressure signal that controls the actuation of the fuel pressure control motor valve 27.

The temperature controller mechanism 68 may further includes a thermostat mechanism, which continually monitors the temperature of the treatment fluid exiting the heat exchanger outlet 52 and automatically adjusts the control signal to the fuel pressure control motor valve 27 to open or close as necessary to maintain a set point temperature.

Thus, the fuel pressure supplied to the multiple burner assemblies 60 is initially generated by the fuel pump 22 and regulated by the fuel pressure control motor valve 27. For example, in the previously noted embodiment, the fuel pump 22 boosts the fuel pressure to approximately 50-100 psi, preferably 60 psi. The fuel pressure is limited to a maximum pressure of 100 psi by the pressure relief valve 24, which permits fuel to vent back into the fuel tank by means of fuel line 25 when the fuel pressure in the pressurized fuel line 26 exceeds 100 psi. The fuel pressure control motor valve 27 regulates the maximum fuel pressure supplied to the multiple burner assemblies 60 via pressurized metered fuel lines 28 to approximately 60 psi.

Recent increases in the price of diesel and other liquid fuels concurrent with relative decreases in the price of liquefied petroleum gas (LPG) and natural gas have made the use of gas-fired burner assemblies an economically attractive alternative. As shown in the Figures and schematically depicted in FIGS. 7B and 8B, in an alternate embodiment the fuel system includes a fuel tank 20A, which is configured near the rear or back end of the trailer 14. The fuel tank 20A is typically pressurized and insulated, and used to store the gas fuel used by the multiple gas-fired burner assemblies 60 configured in the firebox 40. In the one embodiment, the fuel tank 20A is pressurized and can hold up to 83 bbl. (3,500 gallons) of LPG fuel. Alternatively, it is understood that fuel tank 20A may comprise a remote LPG or natural gas pipeline, which is fluidly connected to the system. The fuel system also includes a pressurized fuel line 21A, which supplies gas fuel from the fuel tank supply 20A to a gas regulator mechanism 22A. The gas regulator mechanism 22A controls the downstream gas fuel pressure in the pressurized fuel line 26A, which directs the gas fuel to the multiple burner assemblies 60.

The gas fuel system may also include a gas fuel pressure control motor valve 27A, which regulates the flow of gas fuel from the pressurized fuel line 26A. The pressurized fuel line 26A fluidly connects the outlet of the gas regulator mechanism 22A with the inlet of a gas fuel pressure control motor valve 27A. The fuel pressure control motor valve 27A controls the amount of gas fuel supplied to the multiple gas burner assemblies 60 via pressurized metered fuel lines 28A. As depicted in the drawings, the metered fuel lines 28A may be configured so as to supply pressurized fuel to sets of burner assemblies, which are comprised of more than one burner assembly 60. The fuel pressure control motor valve 27A may be electrically, pneumatically or hydraulically actuated. In a preferred embodiment, the gas fuel pressure control motor valve 27A comprises a pneumatically-actuated flow control valve.

The temperature of the treatment fluid exiting the heat exchanger outlet(s) is a function of three variables: the volumetric flow rate of the treatment fluid through the heat exchanger device; the flow rate of the pressurized secondary air; and the heat generated by the multiple burner assemblies 60 configured in the heat exchanger device. The flow rate of the secondary air is typically held constant during all operations while the volumetric flow rate of the treatment fluid is typically constant for a given operation. Thus, the temperature of the treatment fluid exiting the heat exchanger outlet(s) is controlled by regulating the volume of fuel supplied to the multiple gas-fired burner assemblies 60.

An adjustable temperature controller mechanism 68 may be used to send a control signal, which causes the fuel pressure control motor valve 27A to open or close, thereby increasing or decreasing the volume of fuel supplied to the multiple gas-fired burner assemblies 60 via pressurized metered fuel lines 28A. The control signal may comprise an electrical, wireless, pneumatic, or hydraulic signal. For example, in one embodiment, the adjustable temperature controller mechanism 68 comprises a simple manual rotary or slider rheostat device, which controls an electric signal that controls the actuation of the fuel pressure control motor valve 27A. In another embodiment, the adjustable temperature controller mechanism 68 comprises a simple manual rotary valve, which controls a pneumatic pressure signal that controls the actuation of the fuel pressure control motor valve 27A.

The temperature controller mechanism 68 may further includes a thermostat mechanism, which continually monitors the temperature of the treatment fluid exiting the heat exchanger outlet(s) and automatically adjust the control signal to the fuel pressure control motor valve 27A to open or close as necessary to maintain a set point temperature.

Thus, the gas fuel pressure supplied to the multiple burner assemblies 60 is initially regulated by the gas regulator mechanism 22A and controlled by the fuel pressure control motor valve 27A. The fuel pressure control motor valve 27A regulates the maximum fuel pressure supplied to the multiple gas-fired burner assemblies 60 via pressurized metered fuel lines 28A.

Firebox

As depicted in the Figures, the firebox 40 is configured near the center of the trailer 14. The firebox 40 is a closed-bottomed box having one or more exhaust stacks 42 configured near the top. In a preferred embodiment, the outer shell of the firebox 40 is constructed substantially of 3/16" carbon steel. The firebox 40 houses a single heat exchanger device (e.g., 50 or 50A) and a plurality of burner assemblies 60 for heating a treatment fluid during a single pass through the heat exchanger device. The closed-bottom design of the firebox 40 ensures the plurality of burner assemblies 60 are less susceptible to changes in ambient conditions, such as wind direction or gustiness. The interior walls and bottom of the firebox 40 are lined with an insulating refractory material. The refractive lining 48 is configured between the interior walls and bottom of the firebox 40 and the heat exchanger device. In one embodiment, the refractive lining 48 comprises one or more layers of fiber-type insulation coated with a cementious refractive compound.

In a preferred embodiment, the firebox 40 further includes at least one vent 40*b* and passageway 40*c*, which supplies ambient air from the upper exterior of the firebox 40 to the front of the burner assemblies 60. The vent 40*b* and passageway 40*c* enable the burner assemblies to operate with the access door 40*a* configured in a "closed" position, which significantly reduces the operational noise created by burner assemblies 60 when operating. Moreover, with the burner access doors 40*a* configured in the "down" position, the danger inherent in a blowback event of the burner assemblies is greatly reduced.

Exhaust Stacks

As previously noted, one or more exhaust stacks 42 are configured near the top the firebox 40 providing an exhaust for flue gases to exit the firebox 40. In the depicted embodiments, the firebox 40 further includes a tapered hood assembly 41, which incorporates the one or more exhaust stacks 42. The tapered hood assembly 41 is removable so as to allow access to the heat exchanger device (e.g., 50 or 50A) for servicing. Each exhaust stack 42 also includes a hood door assembly 44, which is opened when the system 100 is operating. As depicted in FIG. 2C, each hood door assembly 44 includes two doors 44*a*, 44*b* which are pivotally mounted to opposing sides of a respective exhaust stack 42.

Hood Door Opening Mechanism

With reference to FIGS. 2B and 2E, each hood door assembly 44 may further include a novel mechanism 46 for opening and closing the opposing hood doors. As shown in greater detail in FIG. 2C, the mechanism 46 comprises a series of bell crank mechanisms, which cause the hood doors to open or close when actuated. The embodiment in FIG. 2C depicts the hood door assembly 44 on the left side in an opened position and the hood door assembly 44 on the right side in a closed position. Each mechanism 46 comprises a piston 46*a* having one end attached to the firebox 40 and a second end attached to a first bell crank 46*b*. The first bell crank is pivotally attached to the side of the firebox 40. When actuated, the piston 46*a* causes the first bell crank 46*b* to rotate about its pivot point $p_1$. The first bell crank 46*b* also includes a pivotally attached push rod linkage 46*c* that connects the first bell crank 46*b* to a second bell crank 46*d*, which is fixably attached to the side edge of one of the hood doors 44*a*. The second bell crank 46*d* is configured so that its pivot point $p_2$ is co-aligned with that of its respective hood door. The second bell crank 46*d* also includes a pivotally attached push rod linkage 46*e* that connects the second bell crank 46*d* to a third bell crank 46*f*, which is also fixably attached to the side edge of the other of the hood doors 44*b*. The third bell crank 46*f* is also configured so that its pivot point $p_3$ is co-aligned with that of its respective hood door. Actuating the piston 46*a* causes the extension or retraction of a piston rod $r_p$, which causes each of the three bell cranks to rotate simultaneously about their respective pivot points. This, in turn, causes the hood doors 44*a*, 44*b* to pivot open or closed as desired. In a preferred embodiment, the piston 46*a* is a pneumatically actuated piston.

Burner Assemblies

The firebox 40 also includes a plurality of burner assemblies 60, which are configured in the lower side of the firebox 40. As will be subsequently described in greater detail, each of the burner assemblies 60 are connected to a fuel system and a pressurized air supply. For example, FIGS. 7A and 8A schematically depicts a first embodiment, which features oil-fired burner assemblies 60 connected to a fuel oil supply system. Liquid fuel is supplied to each burner assembly 60 via the metered pressurized fuel line 28. Similarly, pressurized air for combustion is supplied to each burner assembly 60 via a primary air conduit 78*c*. The pressurized air and fuel are combined in the burner assembly 60 and directed through an atomizer nozzle 64, which projects an atomized air-fuel spray into the firebox 40 where it is combusted. Each burner assembly 60 is configured in the lower side of firebox 40 so as to initially generate a substantially horizontal combustion flow within the firebox 40. Each burner assembly 60 includes self-contained controls for adjusting the fuel-air mixture and an ignition mechanism for initially igniting the fuel-air mixture. In a preferred embodiment, the burner assembly 60 comprises a 780-Series self-proportioning, oil-fired burner manufactured by the Hauck Manufacturing Company of Lebanon, Pa.

Figure 7B:
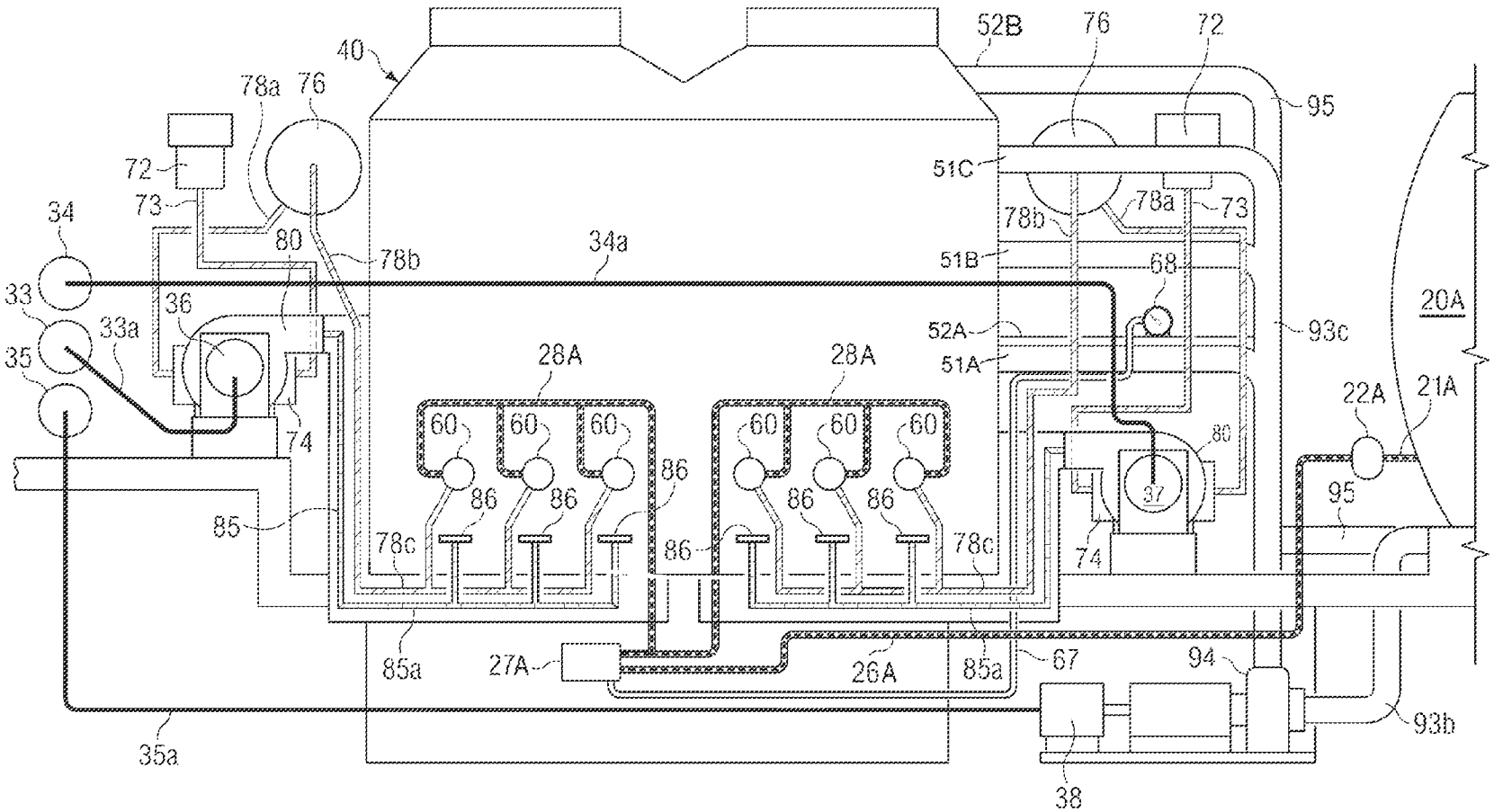
FIG. 7B is a schematic depiction of the hydraulic, fuel, and air supply systems of the embodiment of the Gas-Fired Frac Water Heating System of the present invention.
Figure 8B:
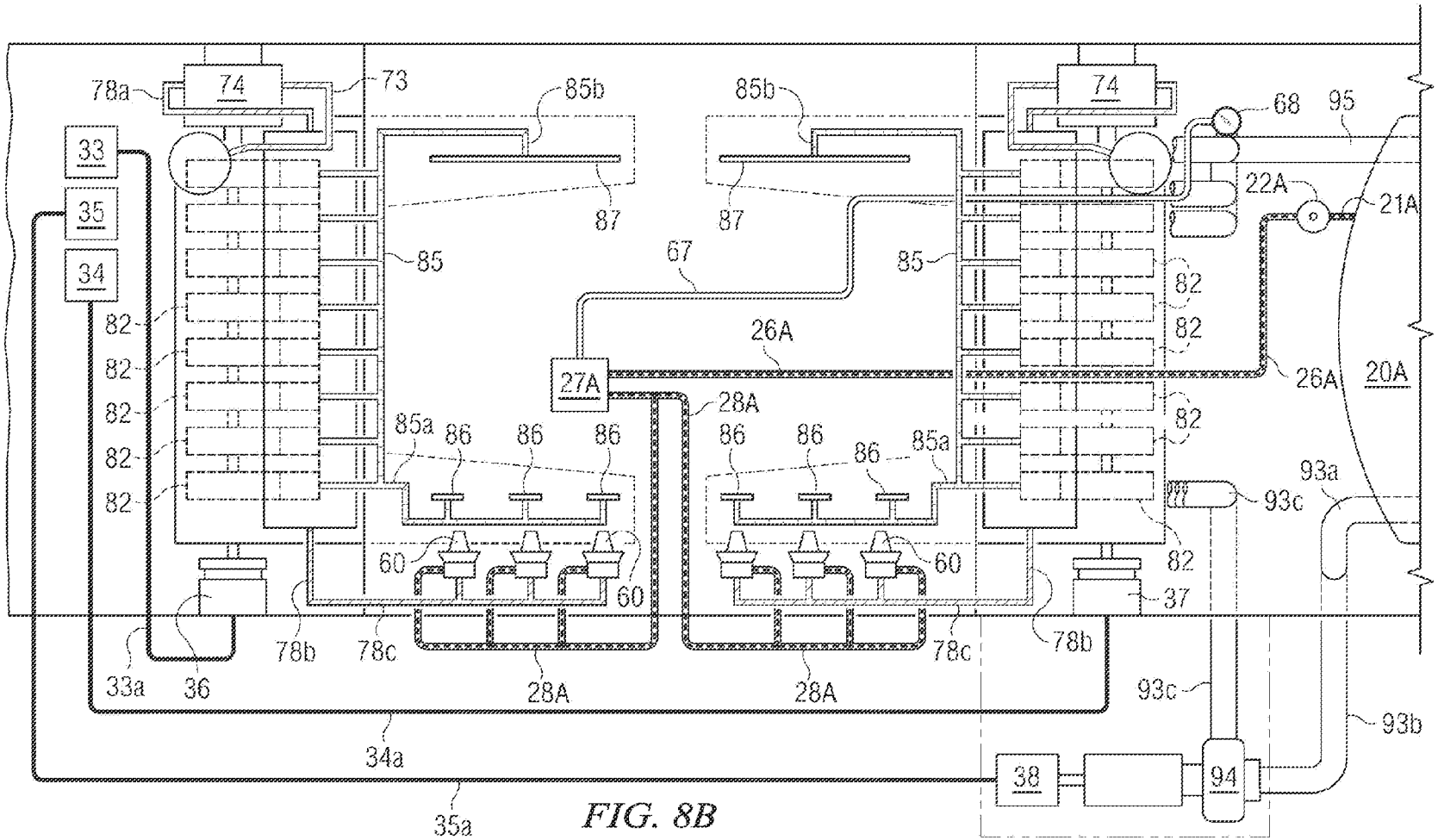
FIG. 8B is an overhead view of a schematic depiction of the hydraulic, fuel, and air supply systems of the embodiment of the Gas-Fired Frac Water Heating System of the present invention shown in FIG. 7B

Similarly, FIGS. 7B and 8B schematically depicts a second embodiment, which features gas-fired burner assemblies 60 connected to a gas fuel supply system. Flammable gas fuel (e.g., LPG or natural gas) is supplied to each gas-fired burner assembly 60 via the metered pressurized gas fuel line 28A. Similarly, pressurized air for combustion is supplied to each gas-fired burner assembly 60 via a primary air conduit 78*c*. The pressurized air and fuel are combined in the burner assembly 60 and directed through a mixer nozzle 64A, which projects an air-gas fuel spray into the firebox 40 where it is combusted. Each gas-fired burner assembly 60 is configured in the lower side of firebox 40 so as to initially generate a substantially horizontal combustion flow within the firebox 40. Each gas-fired burner assembly 60 includes self-contained controls for adjusting the gas fuel-air mixture and an ignition mechanism for initially igniting the gas fuel-air mixture. In a preferred embodiment, the gas-fired burner assembly 60 comprises a 781-Series (with a converter plate kit) gas-fired burner manufactured by the Hauck Manufacturing Company of Lebanon, Pa.

Heat Exchanger

The heat exchanger device contained within the firebox 40 is comprised of a tubular coil which is configured in a highly oscillating or serpentine manner and oriented along multiple axes so as to maximize its exposure to the heat generated by the multiple burner assemblies 60. The heat exchanger device of the present invention may comprise either a single continuous unit or multiple single-pass heat exchanger units arranged in a vertically stacked configuration. In addition, heat exchanger device of the present invention may further comprise a single continuous unit having valve mechanisms that allow it to be configured as either a single continuous unit or as multiple single-pass heat exchanger units.

Single Continuous Heat Exchanger Unit

Figure 4A:
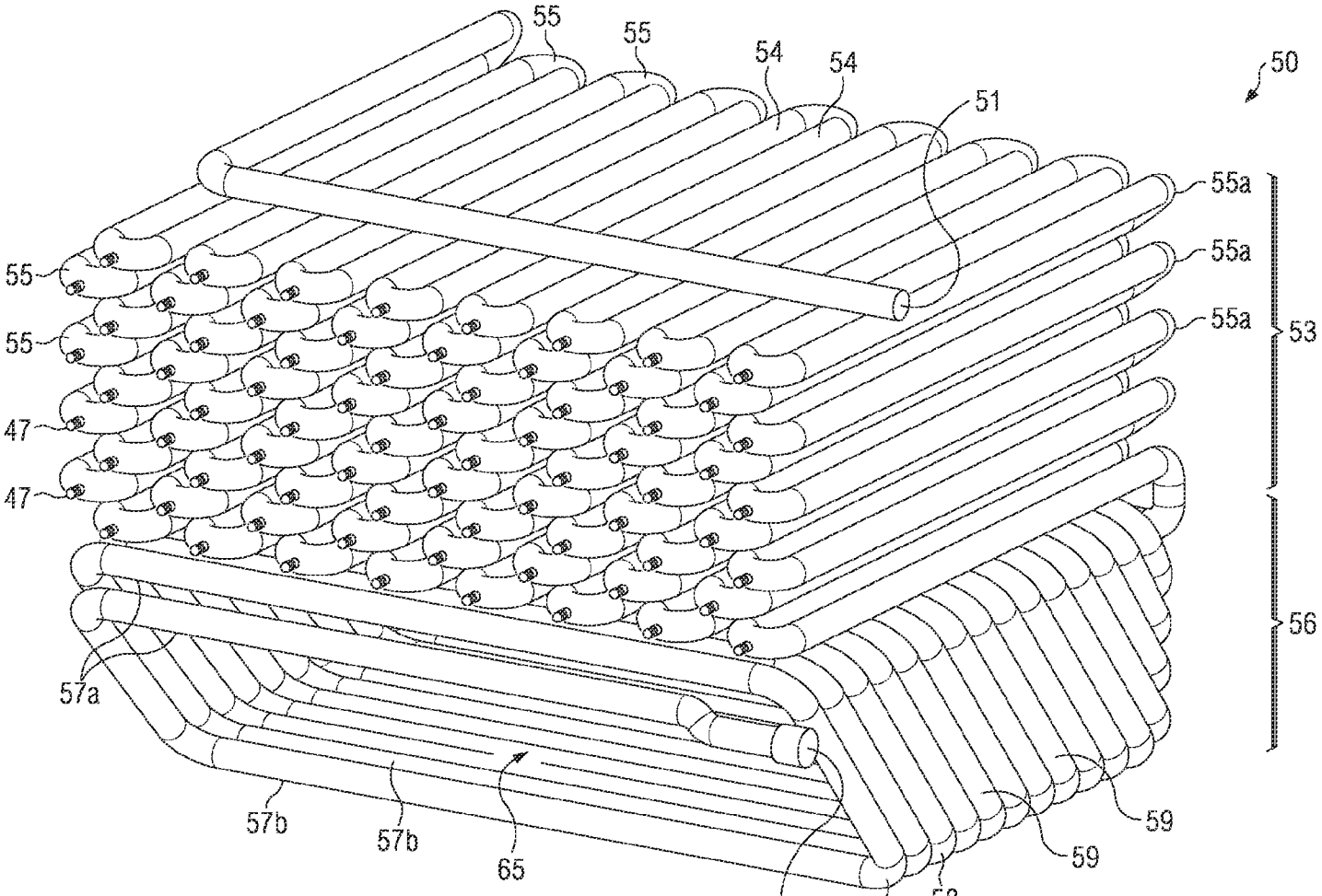
FIG. 4A is a front perspective view of an embodiment of the heat exchanger of the Frac Water Heating System of the present invention.
Figure 4B:
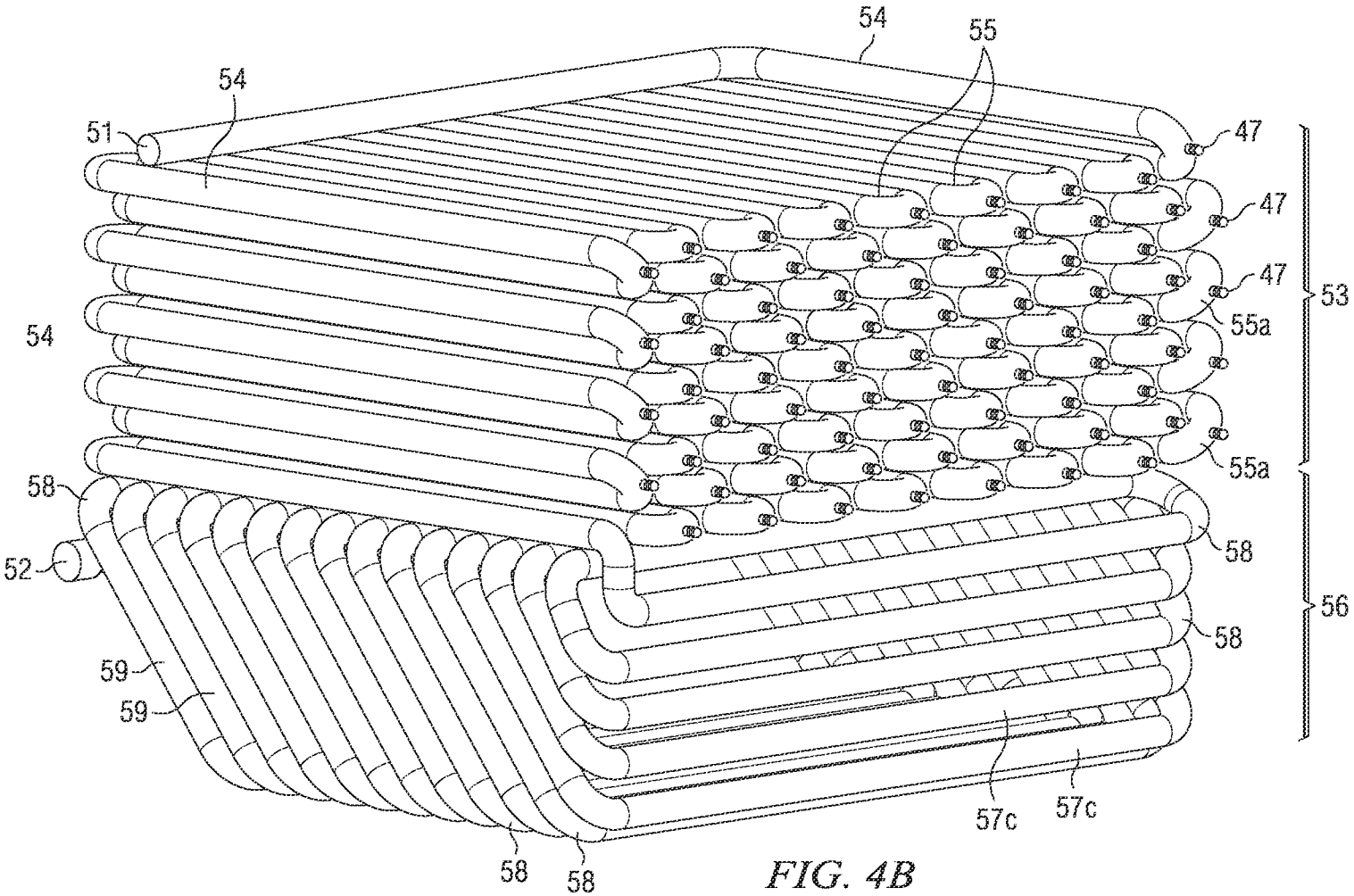
FIG. 4B is a back perspective view of the embodiment of the heat exchanger shown in FIG. 4A.

With reference now to FIGS. 4A-4B and E, an embodiment of the single continuous heat exchanger 50 of the present invention is depicted. The heat exchanger 50 is comprised of a tubular coil which is configured in a highly oscillating and serpentine manner and oriented along two axes so as to maximize its exposure to the heat generated by the burner assemblies 60. The heat exchanger coil 50 includes a single inlet 51 configured at or near the top of the heat exchanger coil 50 and a single outlet 52 configured at or near the bottom of the heat exchanger coil 50. Such a configuration greatly improves the efficiency of the system 100 by minimizing the back pressure exerted on the main fluid pump 94 by the treatment fluid and providing a gravity assist to the flow of treatment fluid through the heat exchanger 50. As the treatment fluid proceeds through a single pass through of the heat exchanger coil 50 it increases in temperature until it reaches the outlet 52 where it is directed, via an outlet conduit 95 and supply hose (not shown), to the well head for injection into the formation.

The depicted embodiment of heat exchanger 50 includes an upper portion 53 configured in stacked horizontal rows of tubing faked down in a series of reversing loops oriented about a vertical axis; and a lower portion 56 configured in a helical coil oriented about a horizontal axis. The upper portion 53 is fluidly connected to the lower portion 56 forming the single heat exchanger 50. In one embodiment, the upper 53 and lower 56 portions of the tubular coil of the heat exchanger 50 comprise approximately 1,300 ft. of 3" seamless steel pipe with weld fittings.

Each row of the upper portion 53 of the heat exchanger 50 is constructed of a plurality of tubes 54 aligned in parallel with each other. The outlet of each tube 54 is connected in series with the inlet of an adjacent tube 54 by means of an approximate 180° curved tube or return bend 55. Similarly, each planar row is connected in series to the adjacent rows above and below by connecting the outlet of the outermost tube in one row with the inlet of the outermost tube in another row by means of a return bend 55*a*. In a preferred embodiment, each planar row is laterally offset from the planar row above and below it so that the tubes 54 in one row are centered on the space between two adjacent tubes 54 in the rows above and below it.

Each return bend 55 may further include an alignment bolt 47 extending from the approximate exterior inflection point of the return bend 55*a*. The multiple alignment bolts 47 correspond to holes formed in an alignment plate 49, which is fixably attached to the upper portion 53 of the heat exchanger 50 by means of mechanical fasteners 45, such as threaded nut fasteners. The alignment plate 49 maintains the alignment of the stacked planar rows of the upper portion 53 of the heat exchanger 50 so that the adjacent rows do not touch and space is maintained between all adjacent tubes 54, thereby enabling the flow of heated air through the upper portion 53 of the heat exchanger 50 during operation.

The upper portion 53 is fluidly connected in series to the lower portion 56 of the heat exchanger 50. As shown in FIGS. 4A-4B, the lower portion 56 transitions to an angled rectangular helical coil configuration, which is oriented about a horizontal plane and defines a five-sided cavity/chamber or tunnel 65. As will be described infra, the tunnel 65 serves as an effective combustion chamber for the multiple burner assemblies 60. The lower portion 56 of the heat exchanger 50 comprises a tubular coil constructed of a plurality of adjacently aligned upper 57*a* and lower 57*b* lateral tubes, which are vertically spaced and connected in series by means of quarter-bend (i.e., approximately 90° bend) tubes 58 and riser tubes 59. The outlet of each lateral tube 57 is fluidly connected in series with the inlet of the next vertically spaced lateral tube 57 by means of a quarter-bend tube 58 followed by a riser tube 59 followed by another quarter-bend tube 58. As shown in FIG.4A, the outlet of the last lateral tube 57 in the tubular coil forming the lower portion 53 is fluidly connected to the outlet 52 of the heat exchanger 50.

Multiple Single-Pass Heat Exchanger Units in Vertically Stacked Configuration

Figure 4C:
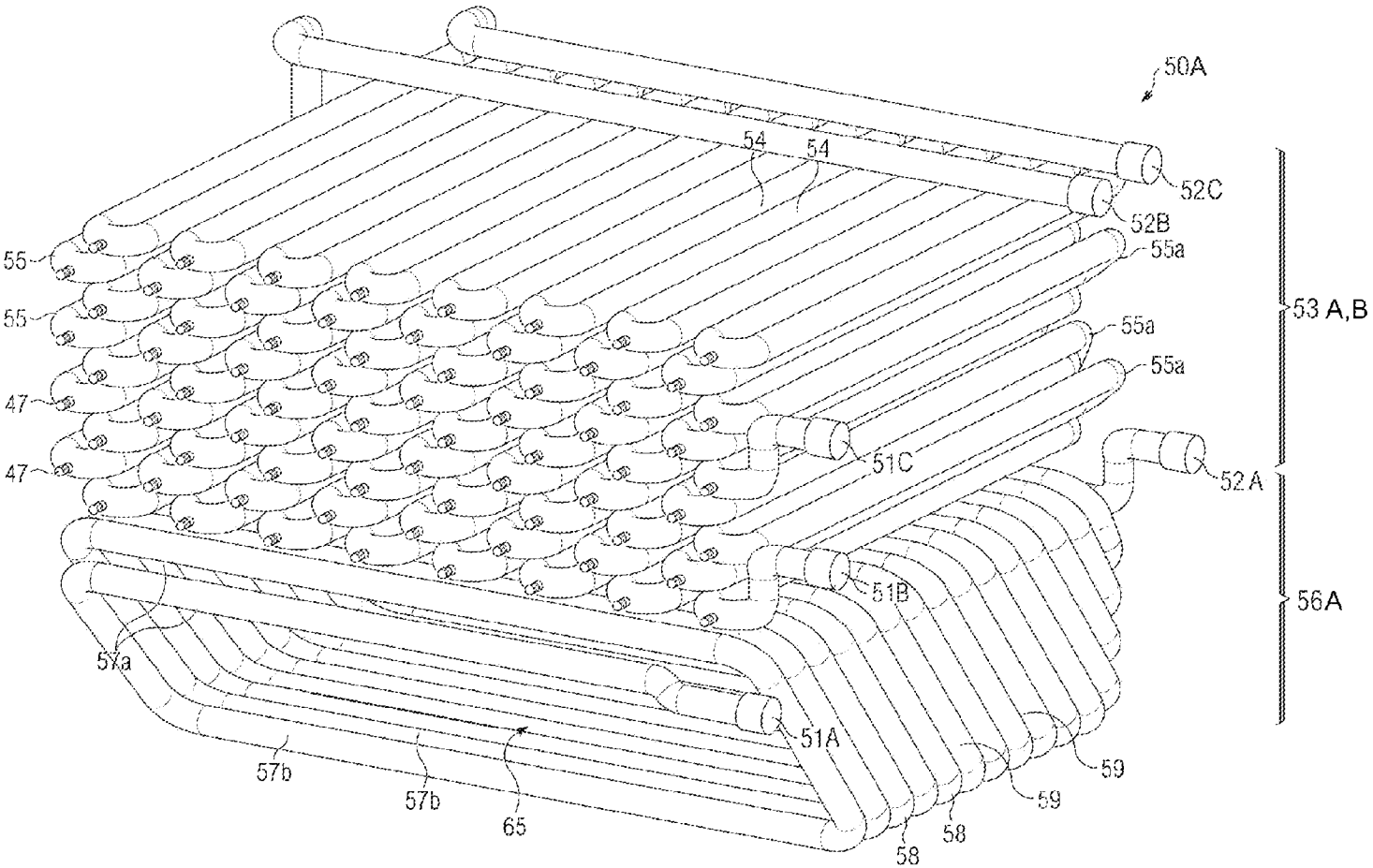
FIG. 4C is a front perspective view of an alternate embodiment of the heat exchanger of the Frac Water Heating System of the present invention.
Figure 4D:
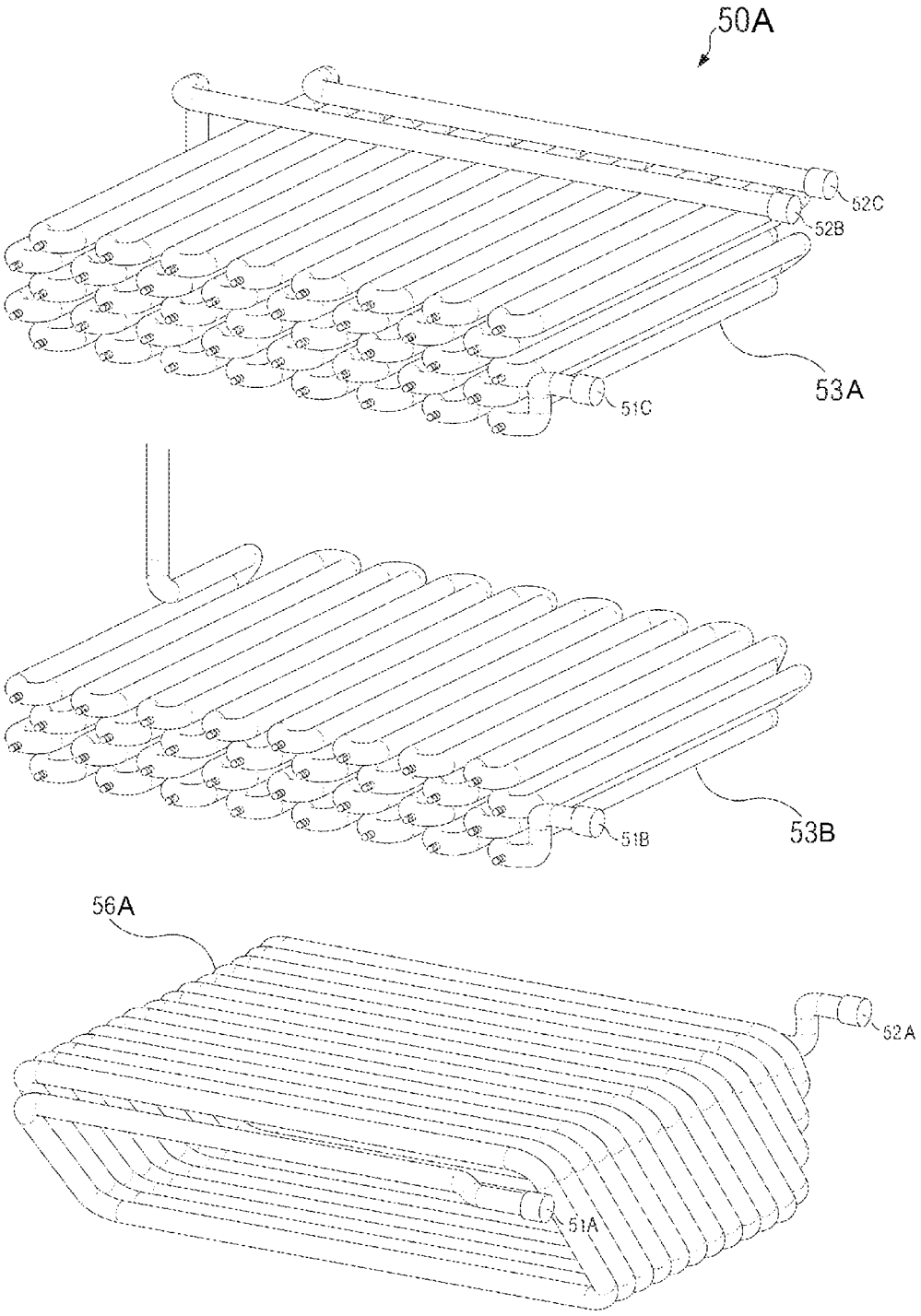
FIG. 4D is a front perspective, exploded view of the embodiment of the heat exchanger shown in FIG. 4C.

With reference now to FIGS. 4C-4D, an embodiment of a multiple single-pass heat exchanger 50A of the present invention is depicted. The heat exchanger 50A is comprised of a tubular coil which is also configured in a highly oscillating and serpentine manner and oriented along two axes so as to maximize its exposure to the heat generated by the burner assemblies 60. However, while having a similar overall design to the previously described single continuous heat exchanger 50, the tubular coil of the multiple single-pass heat exchanger 50A is divided into a plurality of separate single-pass heat exchanger units. Each single-pass heat exchanger unit includes a single inlet, which is fluidly connected to a common intake conduit 93*c*, and a single outlet, which is fluidly connected to a common outlet conduit 95.

While such a configuration can be accomplished by inserting 4-way valves at selected intervals along the tubular lengths of the previously described single continuous heat exchanger 50, the alternate embodiment of the heat exchanger 50A is preferably comprised of two or more separate heat exchanger units arranged in a stacked configuration. For example, as shown in FIGS. 4C-4D, in a preferred embodiment the multiple single-pass heat exchanger 50A of the present invention is comprised of three separate heat exchanger units 56A, 53A, 53B arranged in a vertically stacked configuration.

Each of the heat exchanger units 56A, 53A, 53B includes a single inlet and a single outlet. For example, the lower heat exchange unit 56A includes a single inlet 51A and a single outlet 52A, while the upper heat exchanger unit 53A similarly includes a single inlet 51C and a single outlet 52C. Likewise an intermediate heat exchanger unit 53B configured between the lower 56A and upper 53A heat exchanger units also includes a single inlet 51B and a single outlet 52B outlet. While each of the heat exchanger units has a separate inlet, all of the inlets 51A, 51B, 51C are preferably fluidly connected to the common intake conduit 93*c*. Similarly, while each of the heat exchanger units has a separate outlet, all of the outlets 52A, 52B, 52C are preferably fluidly connected to the common outlet conduit 95. As the treatment fluid proceeds through a single pass of its respective heat exchanger unit 56A, 53A, 53B its temperature increases until it reaches its respective outlet 52A, 52B, 52C where the separate outlet flows are combined and directed, via an outlet conduit 95 and supply hose (not shown), to the well head for injection into the formation.

By dividing the intake stream of treatment fluid into a plurality of inlets the overall flow rate of the treatment fluid through the alternate heat exchanger 50A is significantly increased and the internal operating pressures are greatly lessened.

The depicted embodiment of heat exchanger 50A includes an upper portion 53 configured in stacked horizontal rows of tubing faked down in a series of reversing loops oriented about a vertical axis; and a lower portion 56 configured in a helical coil oriented about a horizontal axis. The alternate heat exchanger 50A is divided into two or more separate heat exchanger units. For example, in the embodiment depicted, the helical coil of the lower portion comprises a single heat exchanger unit 56A, while the upper portion is divided into two separate heat exchanger units 53A, 53B, each having a separate inlet and outlet for receiving treatment fluid.

With the exception of the multiple inlets and outlets, the construction of the alternate heat exchanger 50A is very similar to that of the previously described single pass heat exchanger 50. Thus, each row of the upper portion 53 of the heat exchanger 50A is constructed of a plurality of tubes 54 aligned in parallel with each other. The outlet of each tube 54 is connected in series with the inlet of an adjacent tube 54 by means of an approximate 180° curved tube or return bend 55. Similarly, each planar row is connected in series to the adjacent rows above and below by connecting the outlet of the outermost tube in one row with the inlet of the outermost tube in another row by means of a return bend 55*a*. In a preferred embodiment, each planar row is laterally offset from the planar row above and below it so that the tubes 54 in one row are centered on the space between two adjacent tubes 54 in the rows above and below it.

Each return bend 55 may further include an alignment bolt 47 extending from the approximate exterior inflection point of the return bend 55*a*. The multiple alignment bolts 47 correspond to holes formed in an alignment plate 49, which is fixably attached to the upper portion 53 of the heat exchanger 50 by means of mechanical fasteners 45, such as threaded nut fasteners. The alignment plate 49 maintains the alignment of the stacked planar rows of the upper portion 53 of the heat exchanger 50 so that the adjacent rows do not touch and space is maintained between all adjacent tubes 54, thereby enabling the flow of heated air through the upper portion 53 of the heat exchanger 50 during operation.

The lower heat exchanger unit 56A is constructed in the same manner as the lower portion of the previously described heat exchanger 50. Thus, as similarly shown in FIGS. 4A-4B, the lower heat exchanger unit 56A also transitions to an angled rectangular helical coil configuration, which is oriented about a horizontal plane and defines a five-sided cavity/chamber or tunnel 65. The tunnel 65 serves as an effective combustion chamber for the multiple burner assemblies 60. The lower heat exchanger unit 56A of the heat exchanger 50A comprises a tubular coil comprising a plurality of adjacently aligned upper 57*a* and lower 57*b* lateral tubes, which are vertically spaced and connected in series by means of quarter-bend (i.e., approximately 90° bend) tubes 58 and riser tubes 59. The outlet of each lateral tube 57 is fluidly connected in series with the inlet of the next vertically spaced lateral tube 57 by means of a quarter-bend tube 58 followed by a riser tube 59 followed by another quarter-bend tube 58. As shown in FIGS. 2E and 4C, the outlet 52A of the last lateral tube 57 in the tubular coil forming lower heat exchanger unit 56A is fluidly connected to the outlet conduit 95.

Operation of Heat Exchanger Within Firebox

Figure 4E:
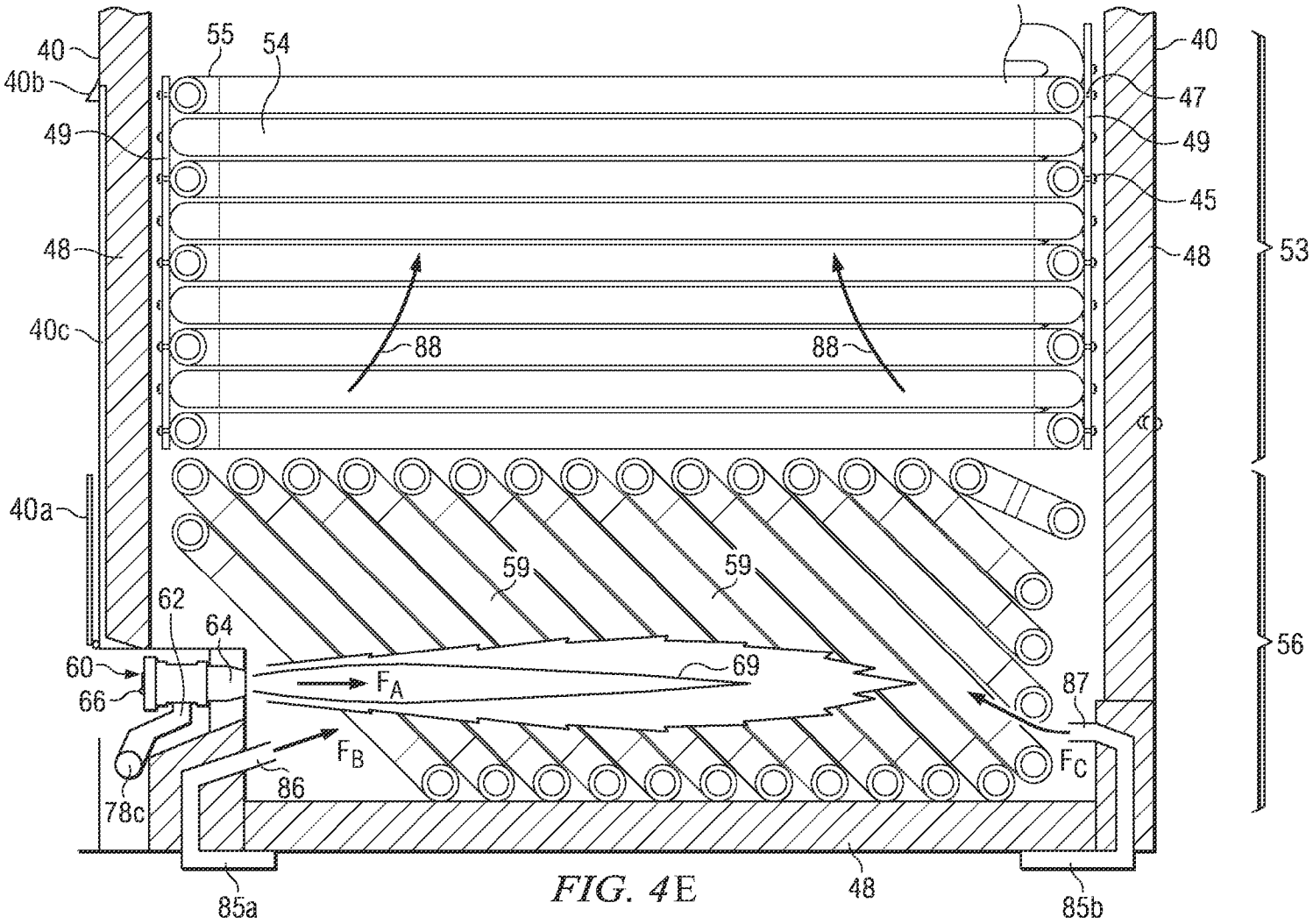
FIG. 4E is a cross-sectional view of the embodiments of the heat exchanger shown in FIGS. 4A-4D installed in the embodiments of the Frac Water Heating System of the present invention.

With reference now to FIG. 4E, a cross-sectional view is shown that depicts either of the embodiments of the heat exchanger device of the present invention (i.e., 50 shown in FIGS. 4A-4B, or 50A shown in FIGS. 4C-4D) installed in the firebox 40 of the present invention is shown. The firebox 40 includes a refractive lining 48 configured between the interior walls and bottom of the firebox 40 and the tubular coil of the heat exchanger 50. In a preferred embodiment, the firebox 40 may further include at least one vent 40*b* and passageway 40*c*, which supplies ambient air from the upper exterior of the firebox 40 to the front of the burner assemblies 60. The passageway 40*c* is typically configured between the exterior wall of the firebox housing 40 and the refractive lining 48. The vent 40*b* and passageway 40*c* enable the burner assemblies 60 to operate with the access door 40*a* configured in a "closed" position, which significantly reduces the operational noise created by burner assemblies 60 when operating. Moreover, with the burner access doors 40*a* configured in the "down" position, the danger inherent in a blowback event of the burner assemblies 60 is greatly reduced.

As previously described, the single pass heat exchanger device 50 comprises a tubular coil which is configured in a highly oscillating and serpentine manner and oriented along two axes so as to maximize its exposure to the heat generated by the burner assemblies 60. The upper portion 53 configured in tightly stacked horizontal rows of tubing faked down in a series of reversing loops oriented about a vertical axis; and a lower portion 56 configured in a helical coil oriented about a horizontal axis. The upper portion 53 is fluidly connected to the lower portion 56 forming the single heat exchanger 50. The attached alignment plate 49 maintains the alignment of the stacked planar rows of the upper portion 53 of the heat exchanger 50 so that the adjacent rows do not touch and space is maintained between all adjacent tubes 54, thereby enabling the flow of heated exhaust or flue gases 88 through the upper portion 53 of the heat exchanger 50 during operation. The lower portion 56 of the heat exchanger 50 transitions to an angled rectangular helical coil configuration, which is oriented about a horizontal plane and defines a five-sided cavity/chamber or tunnel 65.

Likewise, the multiple single-pass heat exchanger 50A has a very similar cross-section but is divided into multiple, vertically stacked heat exchanger units, which each have a separate inlet and outlet. The depicted embodiment of heat exchanger 50A includes an upper portion 53 divided into two separate heat exchanger units 53A, 53B, each having a separate inlet and outlet for receiving treatment fluid; and a lower portion 56 configured in a helical coil heat exchanger unit 56A oriented about a horizontal axis. The two separate heat exchanger units 53A, 53B are each configured in stacked horizontal rows of tubing faked down in a series of reversing loops oriented about a vertical axis. The lower heat exchanger unit 56A is constructed in the same manner as the lower portion of the previously described heat exchanger 50, with the exception of having a separate inlet and outlet from the other heat exchanger units above it. Thus, the lower heat exchanger unit 56A also comprises an angled rectangular helical coil, which is oriented about a horizontal plane and defines a five-sided cavity/chamber or tunnel 65. Therefore, with the exception of the multiple inlets and outlets, the cross-sectional view of both embodiments of heat exchanger devices is, for purposes of illustration, essentially the same.

The tunnel 65 serves as an effective combustion chamber for the multiple burner assemblies 60 configured in the lower side of the firebox 40. Each burner assembly 60 is connected to the fuel system and a pressurized air supply. For example, as schematically depicted in FIGS. 7 and 8, fuel is supplied from the fuel tank 20 to each burner assembly 60 pressurized fuel line 26,26A, fuel pressure control motor valve 27, 27A and the metered pressurized fuel line 28, 28A. Similarly, pressurized air for combustion is supplied to a primary air inlet 62 configured on each burner assembly 60 via a primary air conduit 78*c*. With reference again to FIG. 4E, the primary air and fuel are combined in the burner assembly 60 and directed through an atomizer nozzle 64, which projects an atomized air-fuel spray $F_A$ into the firebox 40 where it is combusted in the previously described cavity/chamber or tunnel 65 formed in the heat exchanger device 50, 50A. It is further noted that each burner assembly 60 is oriented so as to initially generate a substantially horizontal combustion flow 69 within the firebox 40. Each burner assembly 60 includes self-contained controls 66 for adjusting the fuel-air mixture and an ignition mechanism for initially igniting the fuel-air mixture.

The firebox 40 depicted in FIGS. 4E, 7 and 8 further includes ductwork 85*a*, 85*b*, which supply pressurized secondary air to the interior of firebox 40. The pressurized secondary air assists in directing and regulating the flow of heated flue gases 88 through the heat exchanger 50 during operation. The ductwork 85*a*, 85*b* supplies pressurized secondary air to vents 86, 87 configured on opposing sides of the firebox 40. The vents 86, 87 are typically configured so that their respective airflows $F_B$, $F_C$ are generally directed into the cavity/chamber or tunnel 65 formed in the heat exchanger 50. The secondary airflows $F_B$, $F_C$, which are projected from their respective vents 86, 87, assist in regulating and directing the flow of heated flue gases 88 through the heat exchanger 50 during operation.

For example, a first or front vent 86 is configured under the burner assemblies 60 and projects a first flow of secondary pressurized air $F_B$ into the open front portion of the cavity/chamber or tunnel 65 formed in the heat exchanger 50. In one embodiment, the first vent 86 comprises an individual nozzle vent configured under each burner assembly 60. The first flow of secondary pressurized air $F_B$ provides a thermal air barrier that partially insulates the lateral tubes 57*b* on the bottom of the heat exchanger 50 from the substantially horizontal combustion flame 69 generated by the burner assembly 60. In addition, the first flow of secondary pressurized air $F_B$ absorbs the heat produced by the substantially horizontal combustion flow 69 generating a flow of heated flue gases 88, which exhausts up through the heat exchanger 50 during operation. In a preferred embodiment, the first vent 86 is angled at a slightly upward angle, so that the first flow of secondary pressurized air $F_B$ combines with the atomized air-fuel spray $F_A$ to effectively supercharge the resulting combustion flow 69 with additional air.

The second or rear vent 87 is configured on the opposing wall or side from the first vent 86 and burner assemblies 60, and projects a second flow of secondary pressurized air $F_C$ into the rear portion of the cavity/chamber or tunnel 65 formed in the heat exchanger device (e.g., 50 or 50A). As depicted in Figures, the rear portion of the cavity/chamber or tunnel 65 formed in the heat exchanger device (e.g., 50 or 50A) is obscured by the lateral tubes 57*c* traversing the tunnel 65. Thus, the second or rear vent 87 is configured so as to project the second flow of secondary pressurized air $F_C$ through gaps existing between adjacent lateral tubes 57. The injection of the second flow of secondary pressurized air $F_C$ provides a thermal air barrier that partially insulates the lateral tubes 57*c* traversing the back of the heat exchanger device (e.g., 50 or 50A). In addition, the second flow of secondary pressurized air $F_C$ also absorbs the heat produced by the substantially horizontal combustion flow 69 generating a flow of heated flue gases 88, which exhausts up through the heat exchanger device (e.g., 50 or 50A) during operation. In one embodiment, the second vent 87 may also be angled at a slightly upward angle.

Air Supply System

With reference again to the Figures, and in particular to FIGS. 5 and 6 the air supply system of the present invention will be described in greater detail. The air supply system of the present invention is a forced-air or pressurized system which is not susceptible to changes in ambient conditions, such as wind direction or gustiness. The air supply system of the present invention is comprised of primary and secondary air systems. The primary air system supplies large volumes of pressurized air to the multiple burner assemblies 60 configured in the side of the firebox 40. The primary air system includes a high-pressure pump which compresses ambient air and directs it to the primary air inlet 62 of each burner assembly 60 where it is where it is thoroughly combined with the fuel. The secondary air system supplies large volumes of pressurized air to strategic locations within the firebox 40 to control and regulate the heating of the heat exchanger device (e.g., 50 or 50A) and firebox 40. The secondary air system includes a secondary air blower mechanism, which draws in large volumes of ambient air. The secondary air is then directed via ductwork to the previously described vents 86, 87 configured on opposing sides of the firebox 40. The secondary air assists in maximizing the combustion of the fuel/air mixture while directing and regulating the flow of heated flue gases 88 through the heat exchanger device (e.g., 50 or 50A) during operation. By controlling and regulating the heating of the heat exchanger device (e.g., 50 or 50A) and firebox 40 during operation, the frac water heating system of the present invention can continuously heat large volumes of treatment fluid safely.

In the embodiments of the present invention depicted in the Figures, the air supply system is comprised of matched sets of primary and secondary blower systems disposed on opposing sides (i.e., the front and rear) of the firebox 40 in a mirror-image configuration. Each set includes a primary blower system 70 and a secondary blower system 80, which are powered by a single motor mechanism. For example, the first or front of blower system set is powered by motor 36 while the second or rear blower system set is powered by motor 37. The single motor mechanism 36, 37 are preferably hydraulically powered. For example, in the depicted embodiment, the motors 36, 37 are powered by hydraulic pumps 33, 34, respectively, which are driven by the accessory pump drive gear box 32. As noted previously, in a preferred embodiment, the hydraulic pumps 33, 34 comprise mechanically-driven hydraulic pumps which are rated at 5000 psi, but typically operate at approximately 2500-3000 psi.

Figure 5:
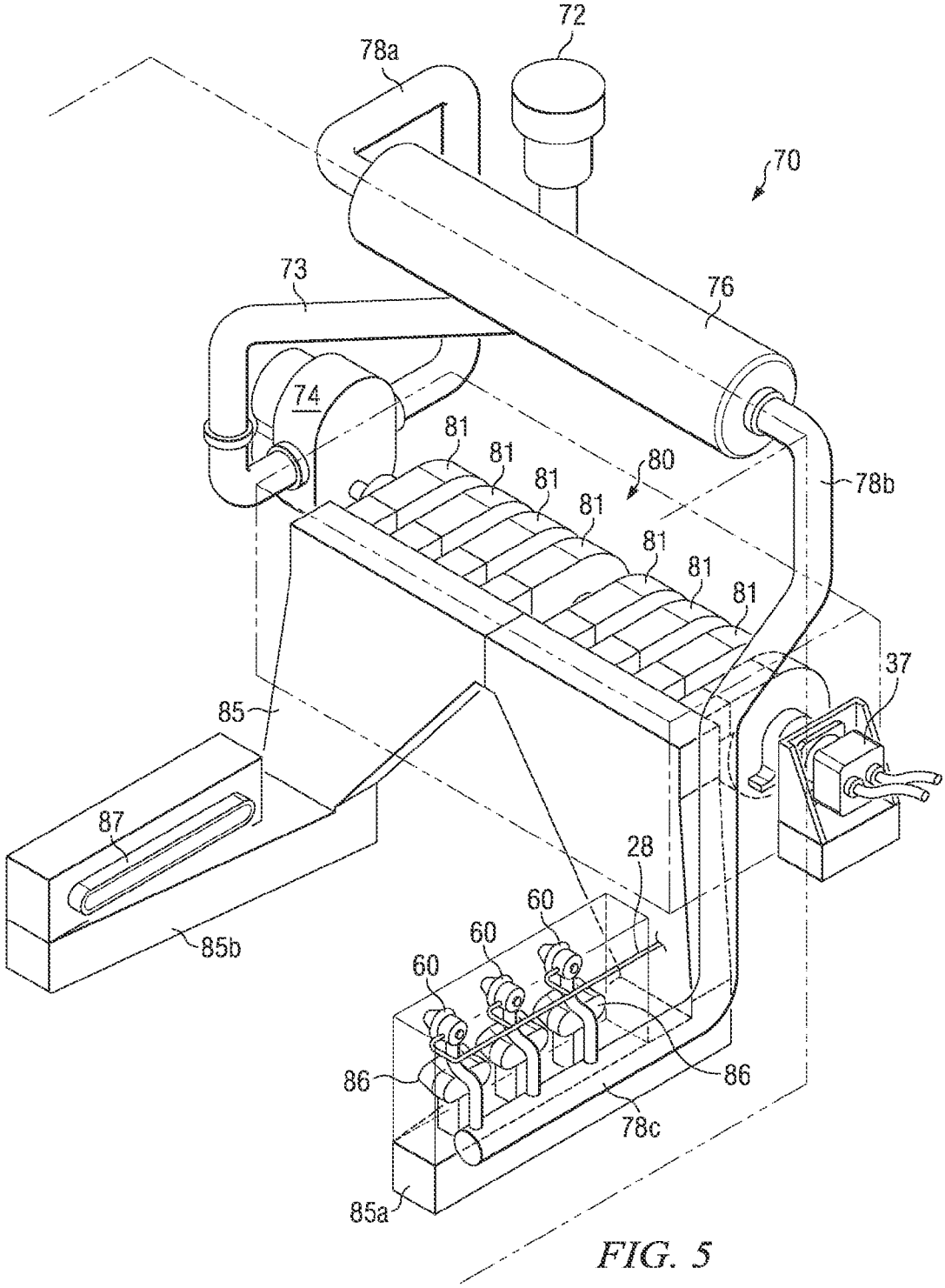
FIG. 5 is perspective view of a portion of the primary and secondary air systems of the Frac Water Heating System of the present invention.
Figure 6:
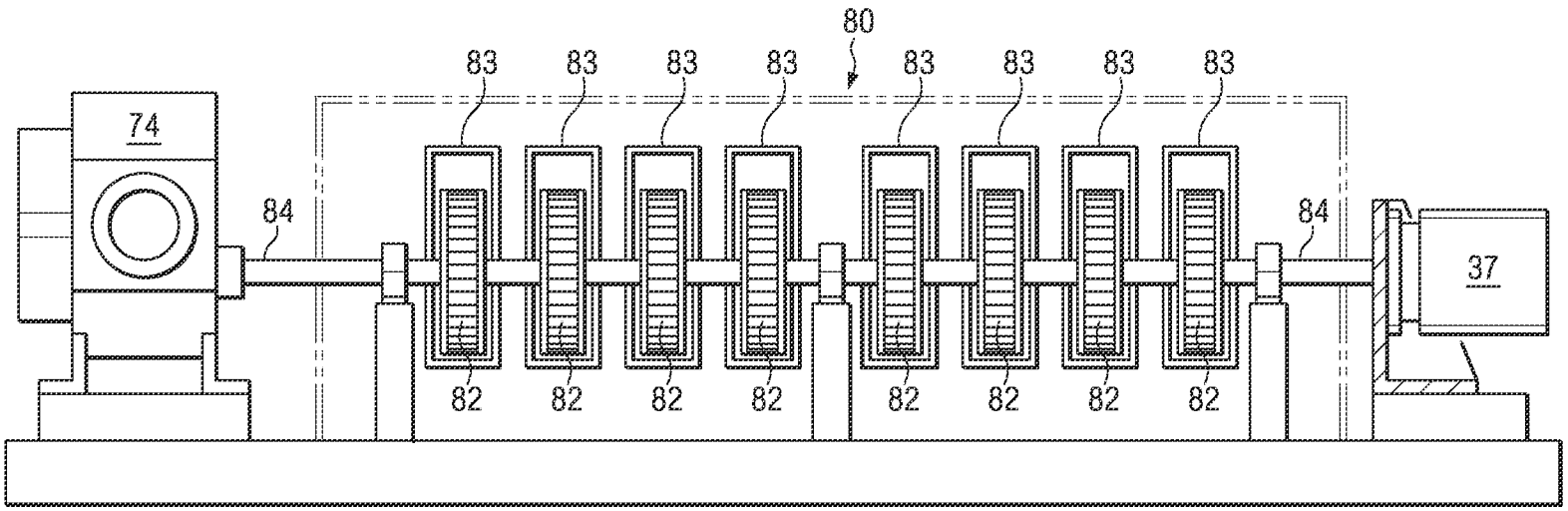
FIG. 6 is cut-away cross-sectional view of a portion of the secondary blower section of the secondary air system of the Frac Water Heating System of the present invention.

As shown in FIG. 5, which depicts in greater detail the second or rear blower system of the present invention, each primary air blower system 70 includes a high-pressure blower pump 74 having an intake which draws ambient air through an intake filter 72 and intake conduit 73. In a preferred embodiment, each high-pressure blower pump 74 is a positive displacement rotary blower. Each high-pressure blower pump 74 is powered by its respective motor mechanism 36, 37 through a rotary driveshaft 84. The high-pressure blower pump 74 compresses the air and directs it via primary air conduits 78*a*, 78*b*, 78*c* to the primary air inlet 62 of each oil-fired burner assembly 60. The primary air conduits 78*a*, 78*b*, 78*c* may further include a primary air silencer 76, which muffles the noise generated by the suction of ambient air into the primary air system 70. In one embodiment, the primary air conduits 78*a*, 78*b*, 78*c* also include a pressure relief "pop-off" valve, which limits the primary air pressure to approximately 5 psi.

Each secondary air system 80 includes one or more secondary air blowers 81, which are also powered by the respective motor mechanism (e.g., 37) through a common rotary driveshaft 84. As shown in the FIG. 6, in one embodiment the one or more secondary air blowers 81 each comprise a conventional centrifugal or squirrel-cage fan mechanism 82 contained in a protective housing 83. As depicted, the one or more fan mechanisms 82 are aligned in a parallel configuration along and coupled to a common rotary driveshaft 84 so that when the driveshaft 84 rotates, each fan mechanism 82 also rotates within its housing 83. It is further noted that the co-alignment of the rotary shaft 84 with the fan mechanisms 82 of the secondary air system 80 and the high-pressure blower pump 74 of the primary air blower system 70 enables both air supply systems to be simultaneously powered by the same motor 37.

The protective housing 83 of each secondary air blower 81 includes an opening, which allows the fan mechanism 82 to draw ambient air into its housing 83 where it is directed to the ductwork of the secondary air system. The output of pressurized air from the secondary air blowers 81 is combined in a first ductwork 85, which then divides into secondary ductwork 85*a*, 85*b*, which supply pressurized secondary air to vents 86, 87 configured on opposing sides of the firebox 40. In the depicted embodiment, secondary air is pressurized to approximately 2.5-3 psi. As previously noted, the vents 86, 87 are typically configured so that their respective airflows $F_B$, $F_C$ are generally directed into the cavity/chamber or tunnel 65 formed in the heat exchanger 50. The secondary airflows $F_B$, $F_C$, which are projected from their respective vents 86, 87, assist in regulating, directing, and enhancing the convective flow of heated flue gases 88 through the heat exchanger 50 during operation.

As shown in the embodiment depicted in FIG. 5, the first or front vents 86 preferably comprise oblong circular vents positioned below the nozzles 64 of the burner assemblies 60. The depicted oblong circular vents 86 extend away from the firebox 40 wall and project one secondary air stream $F_B$ up towards the fuel/air mixture spray $F_A$ generated by the burner fuel nozzle 64. The second or rear vent 87 is configured on the opposing wall of the firebox 40. As noted previously, the configuration of the second oblong circular vents 87 provides a layer of cooling air $F_C$ between the main burner fire and the bottom of the firebox. Moreover, the angular set of the secondary vents 86, 87 causes their respective opposing secondary air flows $F_B$, $F_C$ to collide in the tunnel 65 formed in the heat exchanger device (e.g., 50 or 50A), thereby affecting the flow of heated exhaust or flue gases 88 up and through the upper portion 53 of the heat exchanger device during operation.

The integrated temperature controller mechanism 68 in conjunction with forced-air supply system and refractive insulation lining 48 in the firebox 40 enable the frac water heating system of the present invention to safely heat water continuously. Operation time is limited only by fuel supply. For example, the depicted first embodiment of the present invention 100, which is configured with six (6) burner assemblies, typically consumes 150-165 gallons of fuel per hour. The burner fuel tank 20 on the unit holds about 2500 gallons and is therefore sized for 15-16.5 hours of continuous operation. The auxiliary powerplant 30 has its own fuel tank that holds approximately 150 gallons of fuel that allow it to operate up to 18 hours depending on operating conditions. In the field, operators may have additional fuel delivered every 12 hours or so to allow the system 100 to continue operations on large heating jobs.

Method of Operation

The previously disclosed embodiments of frac water heating system of the present invention includes novel methods for heating large volumes of treatment fluid in a continuously flowing fashion so that on-site heating operations can be performed "on-the-fly", i.e., without the use of preheated stockpiles of treatment fluid. For example, the embodiments of the system of the present invention depicted in the Figures, is capable of heating sufficient quantities of continuously flowing water to conduct "on-the-fly" hydraulic fracturing operations at remote well sites. The frac water heating system of the present invention also includes novel methods for controlling the heating of the treatment fluid as it passes through the system. The frac water heating system of the present invention further includes novel methods for controlling the temperature change and volume flow of treatment fluid as it passes through the system.

Operation of System Having Single Pass Heat Exchanger Device

With reference again to the Figures and in particular FIGS. 7A, 8A and 9A-B, the method of operation of the present invention featuring a single pass heat exchanger device 50 is depicted. A treatment fluid, such as water, is drawn from an ambient fluid source 112 into the system 100. The treatment fluid is then pumped through a single pass of a tubular coil heat exchanger device 50 contained within firebox 40 where it is heated. As the treatment fluid proceeds through a single pass of the entire heat exchanger device 50 it increases in temperature until it reaches the outlet 52 of the heat exchanger device 50 where it is directed via tubular conduits or hose to the well head for injection into the formation.

The main fluid pump 94 is used to control the flow rate of the treatment fluid through the system 100. For example, a supply line 114 extending to the fluid source 112 is connected to the intake manifold 90 so as to put the system 100 in fluid communication with the fluid source 112. The main fluid pump 94 draws the treatment fluid via conduits 93*a*, 93*b* from the fluid source and supplies it to the inlet(s) 51 of the heat exchanger device 50. The main fluid pump 94 has sufficient power to both draw the treatment fluid from the fluid source and pump the treatment fluid through the heat exchanger device 50 and on to the well head for injection into the formation. In addition, auxiliary or booster pumping apparatus may be positioned along the flow line 126 and the flow line 128 to the well head 116 to assist the flow rate of the treatment fluid.

For example, in one embodiment of the frac water heating system 100 of the present invention that features a single-pass, continuous heat exchanger 50, the main fluid pump 94 is capable of supplying treatment fluid to the heat exchanger device 50 at a pressure of about 150 psi. In a preferred embodiment, the main fluid pump 94 is also capable of drawing and pumping a maximum of 252 gpm of treatment fluid through the system 100.

The requisite volumetric flow rate of treatment fluid is typically dictated by the particular operational requirements desired at the well head. By adjusting the speed of the main fluid pump 94, the volumetric flow rate of treatment fluid is controlled. The main fluid pump 94 is driven by a hydraulic motor 38 powered via supply line 35*a* by a hydraulic pump 35 attached to the accessory pump drive gear box 32. Consequently, the speed of the main fluid pump 94 is controlled by the operator using a control lever 12 to increase or decrease the amount of pressurized hydraulic fluid supplied to hydraulic motor 38. In a preferred embodiment, control lever 12 comprises an electronic joystick actuator, which regulates the displacement of the hydraulic pump to change the speed of its respective hydraulic motor. The hydraulic pressure depends on the loads placed on the hydraulic motors.

As the treatment fluid is pumped through the heat exchanger device 50 contained within the firebox 40, the fluid is heated by the transfer of thermal energy generated by the combustion of a fuel/air mixture in the firebox 40. As previously detailed, pressurized primary air and a liquid or gaseous fuel are combined in the multiple burner assemblies 60, which each project an atomized air-fuel spray $F_A$ into the firebox 40 where it is combusted. The burner assemblies 60 are configured near the bottom of the firebox 40 and oriented so as to initially generate a substantially horizontal combustion flow 69 within the firebox 40. Pressurized secondary air assists in directing and controlling the thermal energy generated by the substantially horizontal combustion flow 69 to exhaust in a convective flow up and through the upper portion 53 of the heat exchanger device 50.

The tubular coil heat exchanger device 50 is designed to maximize the heat transfer of the thermal energy within the confines of the firebox 40. The heat exchanger 50 is, therefore, comprised of a tubular coil which is configured in a two interconnected portions, which are oriented along two distinct axes so as to maximize exposure to the heat generated by the burner assemblies. The ambient or cool treatment fluid enters the heat exchanger 50 through the inlet 51 configured at or near the top of the heat exchanger coil 50. As the fluid flows through the upper portion 53 of the heat exchanger 50 thermal energy is transferred by the convective flow of the hot flue gases 88 over and between the stacked horizontal rows of interconnected adjacent tubes faked down in a series of reversing loops oriented about a vertical axis. As the fluid continues through the lower portion 56 of the heat exchanger 50 it flows through a helical coil oriented about a horizontal axis, thermal energy is transferred by the both the convective flow of the hot flue gases 88 and the radiant heat emanating from the substantially horizontal combustion flow 69 within the cavity/chamber or tunnel 65.

The convective flow of flue gases 88 through heat exchanger 50 is substantially enhanced by the secondary air system, which continually supplies large volumes of pressurized air to strategically configured vents 86, 87 on opposing sides of the firebox 40. The secondary air flow is essentially a forced air system which uses air as its heat transfer medium to extract thermal energy from the substantially horizontal combustion flow 69. The vents 86, 87 are positioned near the bottom of the closed-bottom firebox 40 and configured so that their respective airflows $F_B$, $F_C$ are generally directed into the cavity/chamber or tunnel 65 formed in the heat exchanger device 50.

The treatment fluid continues to absorb thermal energy as it flows through the lower portion 56 of the heat exchanger 50 until it reaches the outlet 52 of the heat exchanger 50 where it is directed via tubular 95 and supply line to the well head for injection into the formation.

As the heated treatment fluid exits the outlet 52 of the single continuous heat exchanger 50 its temperature is monitored. The temperature of the treatment fluid exiting the heat exchanger outlet 52 is a function of three variables: the volumetric flow rate of the treatment fluid through the heat exchanger 50; the flow rate of the pressurized secondary air; and the heat generated by the multiple burner assemblies 60 configured in the heat exchanger 50. The flow rate of the secondary air is typically held constant during all operations while the volumetric flow rate of the treatment fluid is typically constant for a given operation. Thus, the temperature of the treatment fluid exiting the heat exchanger outlet 52 is controlled by regulating the volume of fuel supplied to the multiple burner assemblies 60.

In one embodiment, the operator monitors the temperature of the heated treatment fluid as it exits the outlet 52 of the heat exchanger 50. The operator then adjusts the temperature controller mechanism 68 sending a control signal to the fuel pressure control motor valve 27 to increase or decrease the volume of fuel supplied to the multiple burner assemblies 60 via pressurized metered fuel lines 28. The control signal may comprise an electrical, wireless, pneumatic, or hydraulic signal. For example, in the depicted embodiment, the adjustable temperature controller mechanism 68 comprises a simple manual rotary valve, which controls the pneumatic pressure supplied to the fuel pressure control motor valve 27.

In another embodiment, the temperature controller mechanism 68 is an automated thermostat mechanism that continually monitors the temperature of the treatment fluid exiting the heat exchanger outlet 52. An operator inputs a desired temperature reading (i.e., set point temperature). The temperature controller mechanism 68 compares the actual temperature of the treatment fluid exiting the heat exchanger outlet 52 with the set point temperature and automatically adjusts the control signal supplied to the fuel pressure control motor valve 27. For example, if the temperature of the treatment fluid exiting the heat exchanger outlet 52 is less than the set point temperature, the temperature controller mechanism 68 adjusts the control signal supplied to the fuel pressure control motor valve 27 to increase the volume of fuel supplied to the multiple burner assemblies 60 via pressurized metered fuel lines 28 in order to maintain a set point temperature. Conversely, if the temperature of the treatment fluid exiting the heat exchanger outlet 52 is higher than the set point temperature, the temperature controller mechanism 68 adjusts the control signal supplied to the fuel pressure control motor valve 27 to decrease the volume of fuel supplied to the multiple burner assemblies 60 via pressurized metered fuel lines 28 in order to maintain a set point temperature.

The temperature of the treatment fluid is also typically monitored at the inlet 51 of the heat exchanger 50. The temperature spread between the inlet 51 and outlet 52 of the heat exchanger 50, when combined with the volumetric flow rate of treatment fluid, is indicative of the heating capacity of the system. Field testing has determined that the depicted embodiment of the oil-fired heat exchanger system 100 of the present invention is capable of heating ambient water from 70° F. to 210° F. at a maximum volumetric flow rate of 252 gpm. Moreover, field reports further indicate that the system 100 is capable of heating water from 40° F. to 210° F. in ambient atmospheric temperatures below 25° F. at a slightly reduced volumetric flow rate (e.g., 200-250 gpm).

The single continuous heat exchanger 50 excels in heating the treatment fluid to an exceptional degree. However, its flow rate is limited by the generated internal pressures. For example, an embodiment of a single continuous heat exchanger 50 is typically operated at a treatment fluid flow rate of about 4.5 barrels (189 gallons) per minute with an outlet temperature of 205° F. and an internal pressure of approximately 180-200 psi. The superheated water is then typically mixed with cooler water, either in intermediate holding tanks or injected into a flowing stream of cool, ambient temperature water to produce a resulting stream of warm treatment fluid at a target or goal temperature for actual injection into the well head. While the outlet temperature can be adjusted somewhat (e.g., water boils at 212 ° F.), the flow rate is limited by the maximum operating internal pressures of the system. Moreover, the mixing process of the superheated water and the cooler, ambient temperature water must be constantly monitored to ensure that the treatment fluid reaching the well head remains at the target or goal temperature.

Operation of System Having Multiple, Single-Pass Heat Exchangers Device

With reference again to the Figures and in particular FIGS. 7B, 8B and 9A-B, the method of operation of the present invention featuring a multiple, single-pass heat exchanger device 50A is depicted. A treatment fluid, such as water, is drawn from an ambient fluid source 112 into the system 100A. The flow of the treatment fluid is then divided amongst a plurality of inlets 51A-C of the plurality of single-pass heat exchanger units 56A, 53A, 53B. The divided flows of treatment fluid are each then pumped through a single pass of its respective tubular coil heat exchanger units 56A, 53A, 53B contained within firebox 40 where it is heated. As the divided flows of treatment fluid proceed through a single pass of its respective heat exchanger unit it increases in temperature until it reaches its respective outlet 52A-C of the heat exchanger device units 56A, 53A, 53B where the separate flows are recombined into single conduit 95 and directed via tubular conduits or hoses to the well head for injection into the formation.

The main fluid pump 94 is used to control the flow rate of the treatment fluid through the system 100A. For example, a supply line 114 extending to the fluid source 112 is connected to the intake manifold 90 so as to put the system 100A in fluid communication with the fluid source 112. The main fluid pump 94 draws the treatment fluid via conduits 93*a*, 93*b* from the fluid source and supplies it to the plurality of inlets 51A-C of the plurality of single-pass heat exchanger units 56A, 53A, 53B. The main fluid pump 94 has sufficient power to both draw the treatment fluid from the fluid source and pump the treatment fluid through the heat exchanger device 50A and on to the well head for injection into the formation. In addition, auxiliary or booster pumping apparatus may be positioned along the supply line 114 and the flow line 120 to the well head 116 to assist the flow rate of the treatment fluid.

For example, in an embodiment of the alternate frac water heating system 100A of the present invention having a multiple, single-pass heat exchanger device 50A, the main fluid pump 94 is capable of pumping treatment fluid through the heat exchanger device 50A at a significantly higher flow rate. However, because the flow of treatment fluid is divided the internal pressures are greatly decreased. For example, in one embodiment the main fluid pump 94 is capable of drawing and pumping a maximum of 12.5 barrels/minute (525 gpm) of treatment fluid through the system 100A at an inlet pressure of 90-100 psi. The requisite volumetric flow rate of treatment fluid is typically dictated by the particular operational requirements desired at the well head. By adjusting the speed of the main fluid pump 94, the volumetric flow rate of treatment fluid is controlled. The main fluid pump 94 is driven by a hydraulic motor 38 powered via supply line 35*a* by a hydraulic pump 35 attached to the accessory pump drive gear box 32. Consequently, the speed of the main fluid pump 94 is controlled by the operator using a control lever 12 to increase or decrease the amount of pressurized hydraulic fluid supplied to hydraulic motor 38. In a preferred embodiment, control lever 12 comprises an electronic joystick actuator, which regulates the displacement of the hydraulic pump to change the speed of its respective hydraulic motor. The hydraulic pressure depends on the loads placed on the hydraulic motors.

As the treatment fluid is pumped through the multiple heat exchanger units (e.g., 56A, 53A, 53B) of the alternate heat exchanger device 50A contained within the firebox 40, the fluid is heated by the transfer of thermal energy generated by the combustion of a fuel/air mixture in the firebox 40. As previously detailed, pressurized primary air and a liquid or gaseous fuel are combined in the multiple burner assemblies, which each project an atomized air-fuel spray $F_A$ into the firebox 40 where it is combusted. The burner assemblies 60 are configured near the bottom of the firebox 40 and oriented so as to initially generate a substantially horizontal combustion flow 69 within the firebox 40. Pressurized secondary air assists in directing and controlling the thermal energy generated by the substantially horizontal combustion flow 69 to exhaust in a convective flow up and through the upper portion 53 of the heat exchanger device 50.

The multiple heat exchanger units (e.g., 56A, 53A, 53B) of the alternate tubular coil heat exchanger device 50A are designed to maximize the heat transfer of the thermal energy within the confines of the firebox 40. The heat exchanger 50A is, therefore, comprised of multiple tubular coils which are oriented along two distinct axes so as to maximize exposure to the heat generated by the burner assemblies. The ambient or cool treatment fluid enters the alternate heat exchanger 50A through one of the multiple inlets 51A-C of the plurality of heat exchanger units. As the treatment fluid flows through a single pass of its respective heat exchanger unit thermal energy is transferred by the convective flow of the hot flue gases 88 and the radiant heat emanating from the substantially horizontal combustion flow 69 within the cavity/chamber or tunnel 65.

The convective flow of flue gases 88 through heat exchanger 50 is substantially enhanced by the secondary air system, which continually supplies large volumes of pressurized air to strategically configured vents 86, 87 on opposing sides of the firebox 40. The secondary air flow is essentially a forced air system which uses air as its heat transfer medium to extract thermal energy from the substantially horizontal combustion flow 69. The vents 86, 87 are positioned near the bottom of the closed-bottom firebox 40 and configured so that their respective airflows $F_B$, $F_C$ are generally directed into the cavity/chamber or tunnel 65 formed in the heat exchanger device 50A.

The treatment fluid continues to absorb thermal energy as it flows through its respective heat exchanger unit until it reaches the outlet 52A-C of its respective heat exchanger unit 56A, 53A, 53B where it is collected and directed via tubular conduits or hose to the well head for injection into the formation. As the heated treatment fluid exits the outlet 52A-C of its respective heat exchanger unit 56A, 53A, 53B its temperature is monitored. The temperature of the treatment fluid exiting each heat exchanger unit 56A, 53A, 53B is a function of four variables: the size or length of the heat exchanger unit, the volumetric flow rate of the treatment fluid through the heat exchanger unit; the flow rate of the pressurized secondary air; and the heat generated by the multiple burner assemblies 60 configured in the heat exchanger device 50A. Preferably, the respective heat exchanger units 56A, 53A, 53B are designed so that the temperature increase of the treatment fluid through the heat exchanger device 50A is balanced and consistent. The flow rate of the secondary air is typically held constant during all operations while the volumetric flow rate of the treatment fluid is typically constant for a given operation. Thus, the temperature of the treatment fluid exiting the heat exchanger outlets 52A-C is typically controlled by regulating the volume of fuel supplied to the multiple burner assemblies 60.

In one embodiment, the operator monitors the temperature of the heated treatment fluid as it exits the outlets 52A-C of the heat exchanger device 50A. The operator then adjusts the temperature controller mechanism 68 sending a control signal to the fuel pressure control motor valve 27 to increase or decrease the volume of fuel supplied to the multiple burner assemblies 60 via pressurized metered fuel lines 28. The control signal may comprise an electrical, wireless, pneumatic, or hydraulic signal. For example, in the depicted embodiment, the adjustable temperature controller mechanism 68 comprises a simple manual rotary valve, which controls the pneumatic pressure supplied to the fuel pressure control motor valve 27.

In another embodiment, the temperature controller mechanism 68 is an automated thermostat mechanism that continually monitors the temperature of the treatment fluid exiting the heat exchanger outlets 52A-C. An operator inputs a desired temperature reading (i.e., set point temperature). The temperature controller mechanism 68 compares the actual temperature of the treatment fluid exiting the heat exchanger units' outlets 52A-C with the set point temperature and automatically adjusts the control signal supplied to the fuel pressure control motor valve 27. For example, if the temperature of the treatment fluid exiting the heat exchanger outlet 52 is less than the set point temperature, the temperature controller mechanism 68 adjusts the control signal supplied to the fuel pressure control motor valve 27 to increase the volume of fuel supplied to the multiple burner assemblies 60 via pressurized metered fuel lines 28 in order to maintain a set point temperature. Conversely, if the temperature of the treatment fluid exiting the heat exchanger outlet 52 is higher than the set point temperature, the temperature controller mechanism 68 adjusts the control signal supplied to the fuel pressure control motor valve 27 to decrease the volume of fuel supplied to the multiple burner assemblies 60 via pressurized metered fuel lines 28 in order to maintain a set point temperature.

The temperature of the treatment fluid is also typically monitored at the inlets 51A-C or the intake conduit 93*c* of the heat exchanger device 50A. The temperature spread between the respective inlets 51A-C and outlets 52A-C of the heat exchanger device 50A, when combined with the volumetric flow rate of treatment fluid, is indicative of the heating capacity of the system. While the temperature spread of the alternate heat exchanger device 50A is markedly less than that of a similarly sized single pass continuous heat exchanger device 50 due to the increase volumetric flow rate of the treatment fluid and decreased exposure time within the firebox 40, the heating capacity is very similar. Field testing has determined that an embodiment of the heat exchanger system 100A of the present invention is capable of increasing the temperature of treatment fluid (i.e., ΔT) 60 degrees Fahrenheit at a high volumetric flow rate. For example, initial field tests indicate that the system 100A is capable of heating water from 40° F. to 100° F. in ambient atmospheric temperatures of 29° F. at a volumetric flow rate of 12.5 barrels/minute (525 gpm).

Method of Use for Supplying Heated Treatment Fluid to a Well Head

The two disclosed embodiments of heat exchanger devices each exhibit pronounced, yet different, strengths in supplying heated treatment fluid to a well head for injection into a formation. For example, the single continuous heat exchanger device 50 excels at heating the treatment fluid to an exceptional degree, but its flow rate, while exceptional when compared to conventional frac water heaters, is limited somewhat by the generated internal pressures. In contrast, while the multiple, single-pass heat exchanger device 50A is not able to heat treatment fluid to the same degree as the other heat exchanger device 50, its flow rate capacity is enhanced greatly. Thus, different methods of use may be employed depending upon which of the two disclosed embodiments of heat exchanger devices is used in a frac water heating system.

For example, an embodiment of a frac water heating system 100 having a single continuous heat exchanger 50 is typically operated at a treatment fluid flow rate of about 4.5 barrel (189 gallons) per minute with an outlet temperature of 205° F. and an internal pressure of approximately 180-200 psi. Since the target or goal temperature of the treatment fluid actually injected into the well head is usually much lower, the superheated water is typically mixed with cooler water, either in holding tanks or injected into a flowing stream of cool, ambient temperature water, to produce a resulting stream of warm treatment fluid at a target or goal temperature for actual injection into the well head. Thus, the flow rate or volume of water heated to the target or goal temperature is increased by effectively diluting the superheated water with cooler water. While effective in producing large quantities of heated treatment, such methods often require additional mixing manifolds, holding and surge tanks, as well as complicated fluid supply lines and systems between the frac water heating system and the well head. Moreover, the high outlet temperature and internal pressures that the frac water heating system 100 generates in accordance with the method requires constant vigilance to ensure that the system operates in a safe manner.

Alternatively, methods for using a frac water heating system 100A having a multiple, single-pass heat exchanger device 50A are even more straightforward. For example, with reference to FIGS. 9A and 9B, two methods of use 110, 150 are depicted which illustrate a greatly simplified and more efficient system. A source of treatment fluid water source 112 can be a reservoir, lake or other source of water. An embodiment of the frac water heating system 100A of the present invention having multiple, single-pass heat exchanger device 50A is used to heat treatment fluid for use in frac operations in an oil well. In general, such frac operations can be seen in U.S. Pat. No. 4,137,182, hereby incorporated herein by reference.

The prepared fracking fluid (i.e., water plus selected chemical (optional) and proppant) to be injected into an oil well 116 as part of a hydraulic fracturing operation typically includes a treatment fluid (e.g., water) heated to a target temperature by the frac water heating system 100A. A pumping apparatus 117, which can include a truck and trailer, pumps the prepared fracking fluid into the well 116.

Figure 2D:
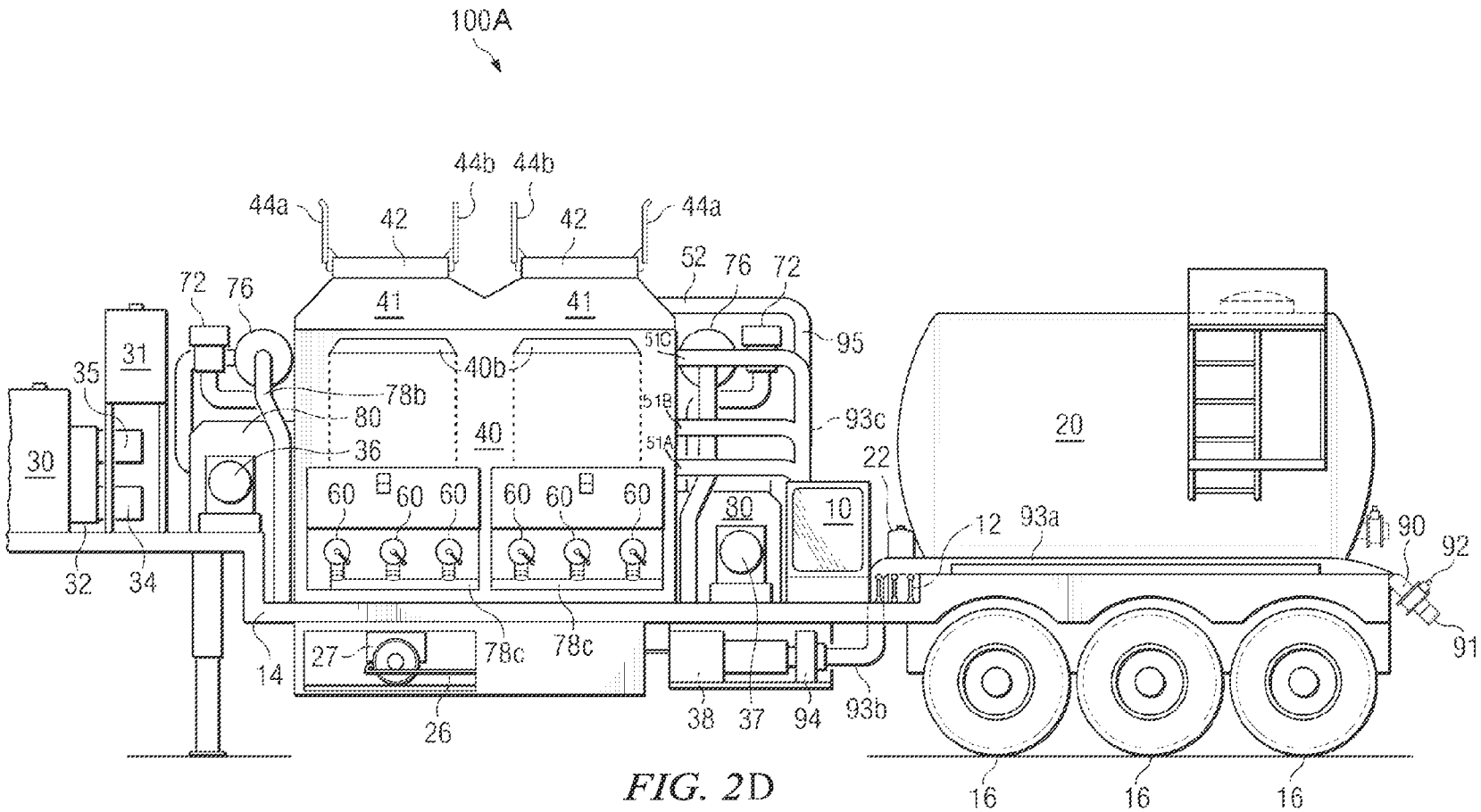
FIG. 2D is a left side elevation view of the alternate embodiment of the Frac Water Heating System of the present invention shown in FIG. 1B.
Figure 2E:
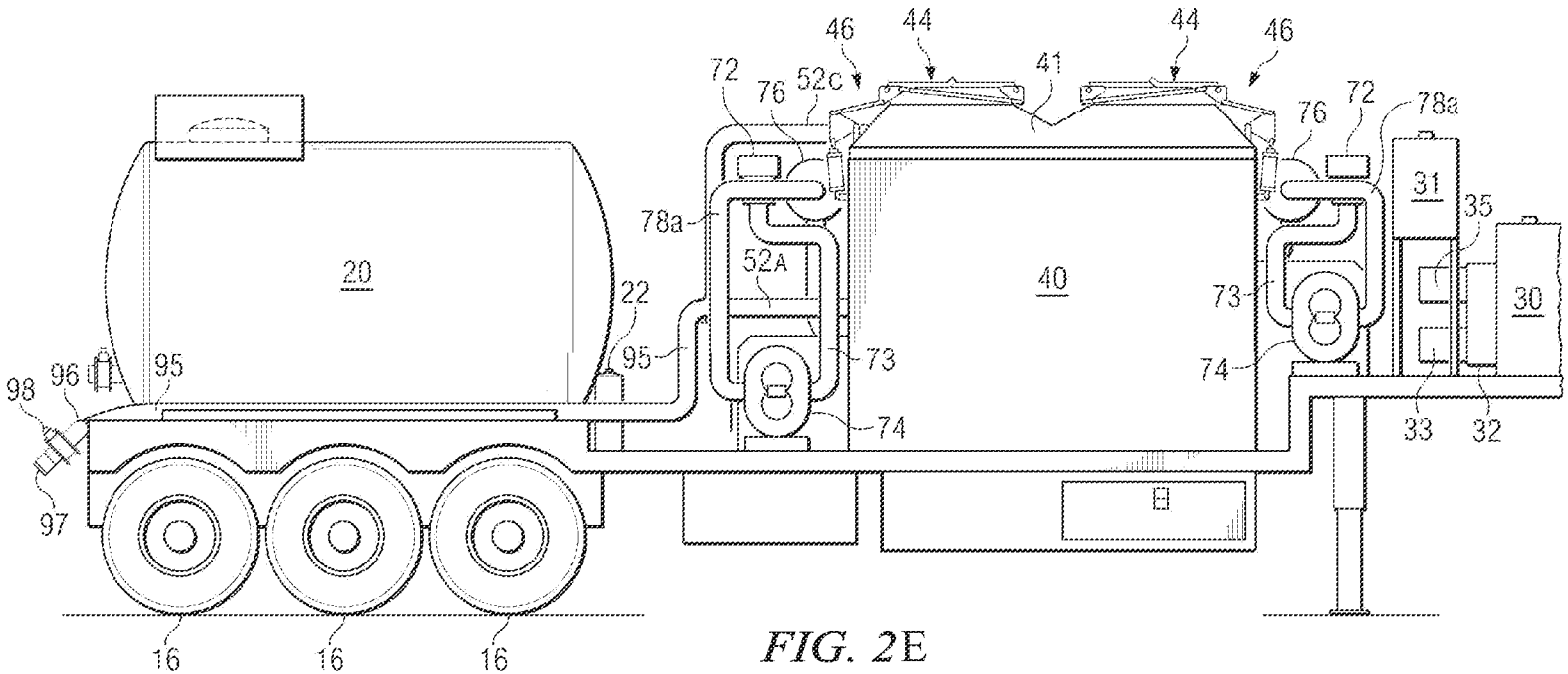
FIG. 2E is a right side elevation view of the alternate embodiment of the Frac Water Heating System of the present invention shown in FIG. 1B.
Figure 3A:
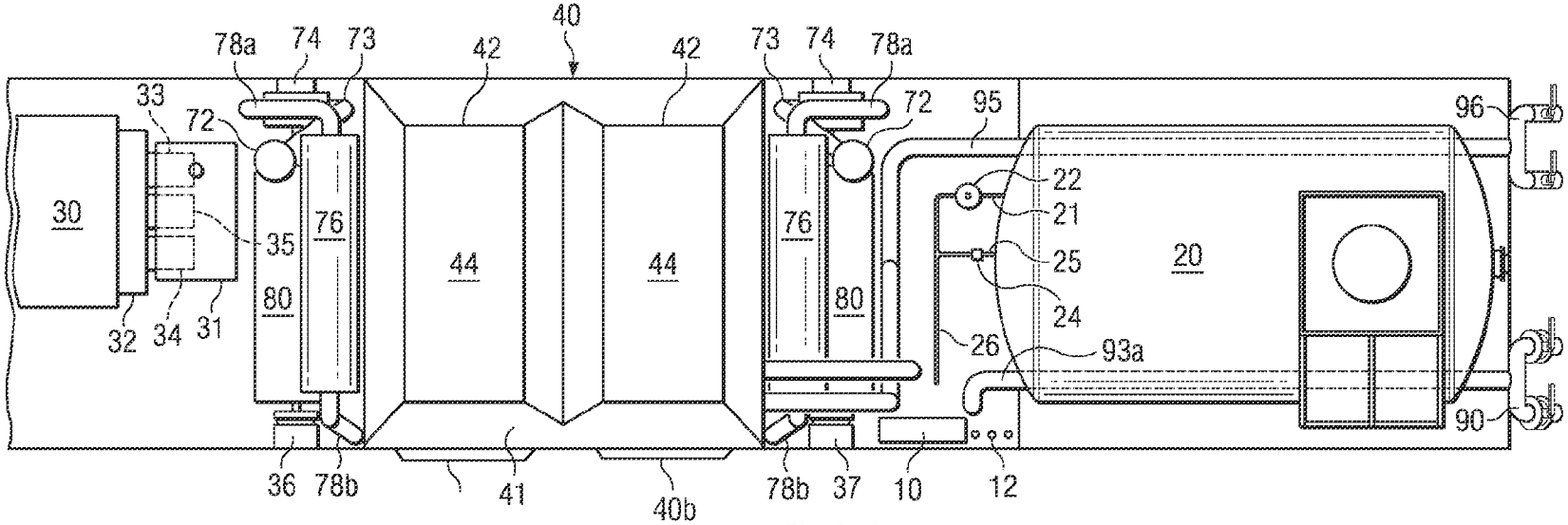
FIG. 3A is an overhead plan view of the embodiment of the Frac Water Heating System of the present invention shown in FIG. 1A.
Figure 3B:
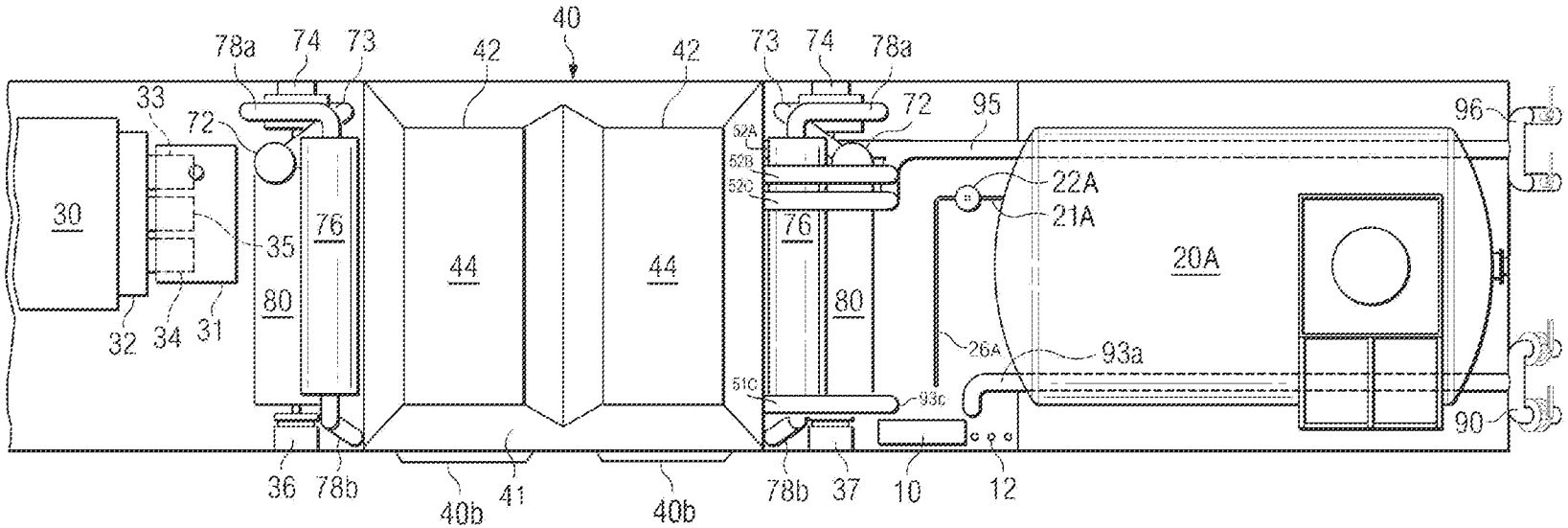
FIG. 3B is an overhead plan view of the alternate embodiment of the Frac Water Heating System of the present invention shown in FIG. 1B.
Figure 9A:
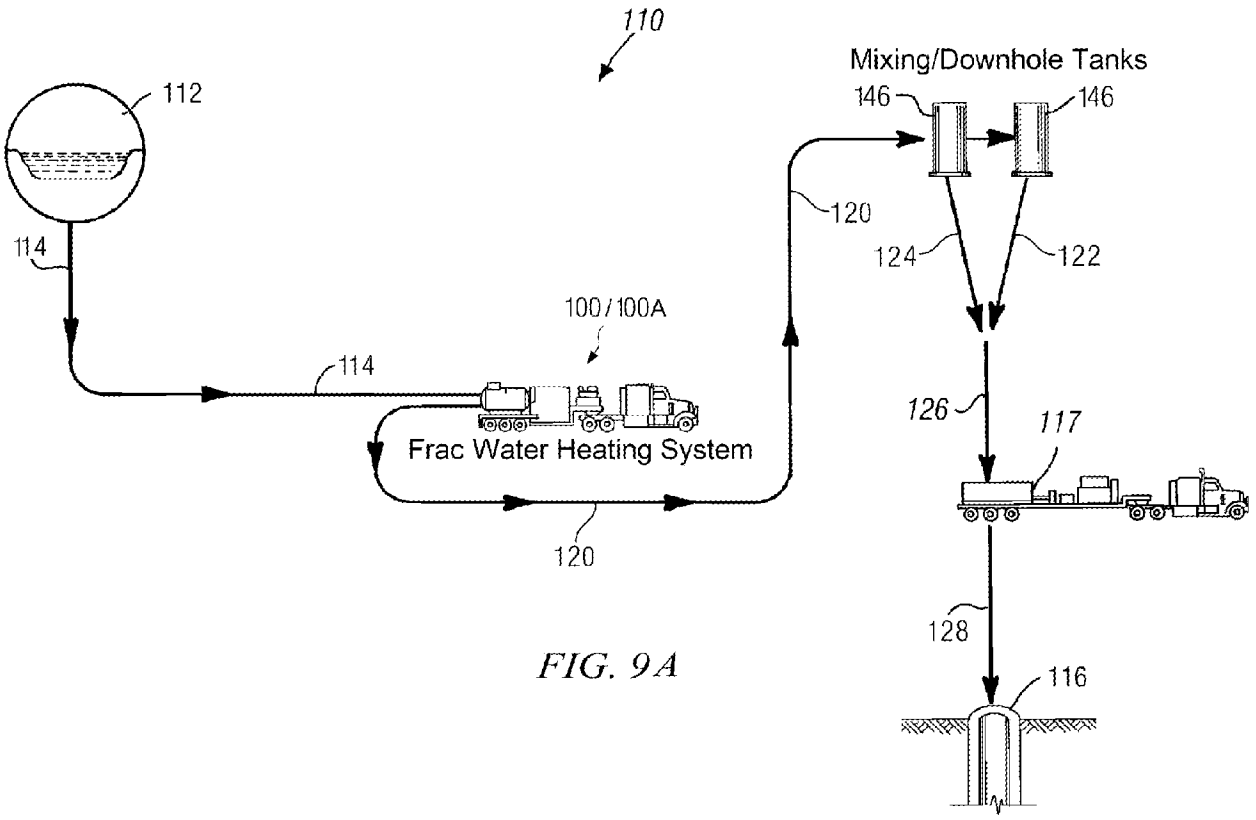
FIG. 9A is a schematic diagram of a preferred embodiment of the method of the present invention.

As shown in FIGS. 2D-E and 9A, treatment fluid (i.e., water) from a source 112 flows in supply line 114 to the intake manifold 90 of the frac water heating system 100A where it proceeds to be heated in accordance with the process of the present invention discussed previously. Upon heating to the target or goal temperature, the heated water is directed via outlet conduit 95 and manifold 96 to flow line 120, which transfers the warmed water between the frac water heating system 100A and the mixing tanks or downhole tanks 146. The mixing tanks 146 can be used to mix any selected chemical and/or proppants with the heated treatment fluid that has been discharged from the frac water heating system 100A creating a prepared fracking fluid that is ready for use in hydraulic fracturing operations in the well 116. Flow lines 122, 124 and 126 illustrate the transfer of the prepared fracking fluid from mixing tanks or downhole tanks 146 to pumping apparatus 117 and then into the well 116 for use in fracking operations.

Figure 9B:
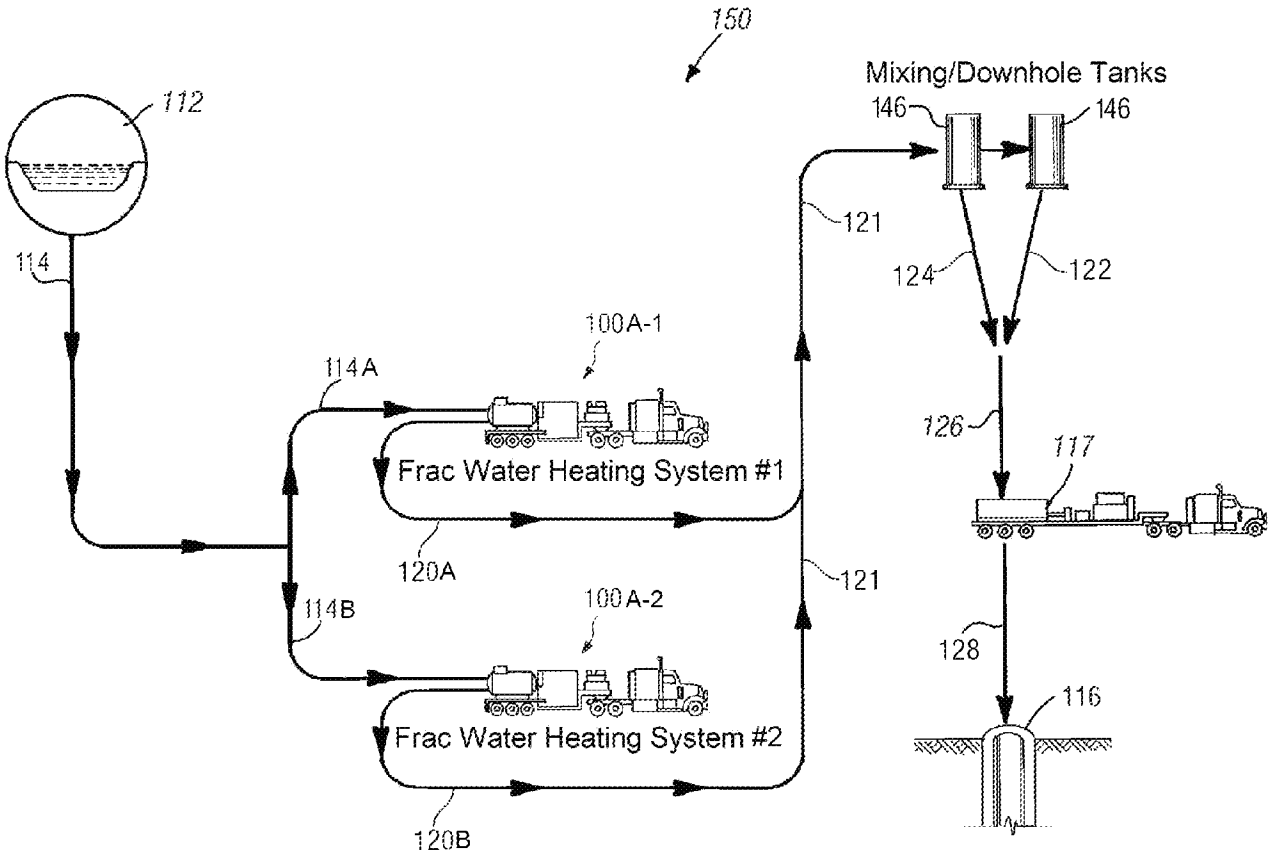
FIG. 9B is a schematic diagram of an alternative embodiment of the method of the present invention.

To achieve greater flow rates of heated water, multiple frac water heating systems 100A can also be used in combination with one another. For example, as shown in FIGS. 2D-E and 9B, two or more frac water heating systems 100A are preferably arranged in a parallel configuration to heat the water from a common source, all of which is done on a continuous flow basis. The multiple frac water heating systems typically draw the treatment fluid from a common source 112. For example, in the depicted embodiment, treatment fluid (i.e., water) from a source 112 flows in supply line 114, which is divided into flowlines 114A and 1148. Flowline 114A is fluidly connected to the intake manifold 90 of a first frac water heating system 100A-1, where it proceeds to be heated in accordance with the process of the present invention discussed previously. Likewise, flowline 1148 is fluidly connected to the intake manifold 90 of a second frac water heating system 100A-2, where it proceeds to be heated in accordance with the process of the present invention discussed previously.

Upon heating to the target or goal temperature, the heated water from the first frac water heating system 100A-1 is directed via its outlet conduit 95 and manifold 96 to flow line 120A, which transfers the warmed water produced by the first frac water heating system 100A-1 to a common flowline 121, which flows into the mixing tanks or downhole tanks 146. Similarly, upon heating to the target or goal temperature, the heated water from the second frac water heating system 100A-2 is directed via its outlet conduit 95 and manifold 96 to flow line 1208, which transfers the warmed water from the second frac water heating system 100A-2 to the common flowline 121 that flows into the mixing tanks or downhole tanks 146. From that point on, the two processes 110, 150 are essentially the same. The common flowline 121 transfers the combined flows of heated treatment fluid discharged by the multiple frac water heating systems to the mixing or downhole tanks 146.

The mixing tanks 146 can be used to mix any selected chemical and/or proppants with the heated treatment fluid from the multiple frac water heating systems to create a prepared fracking fluid that is ready for use in hydraulic fracturing operations in the well 116. Flow lines 122, 124 and 126 illustrate the transfer of the prepared fracking fluid from mixing tanks or downhole tanks 146 to pumping apparatus 117 and then into the well 116 for use in fracking operations. The moving stream of uniformly heated water can also be piped to surge tank(s) which can be used as a safety buffer between the water flow and the pumping operations, in the case of a mechanical breakdown or operational problems.

Alternatively, the multiple frac water heating systems may each acquire its treatment fluid from a different source or independently from the same source. Similarly, the multiple frac water heating systems may each transfer its warm treatment fluid to the mixing tanks or downhole tanks 146 via a flowline that is separate and distinct from the flowline used in common by the others.

Figure 9C:
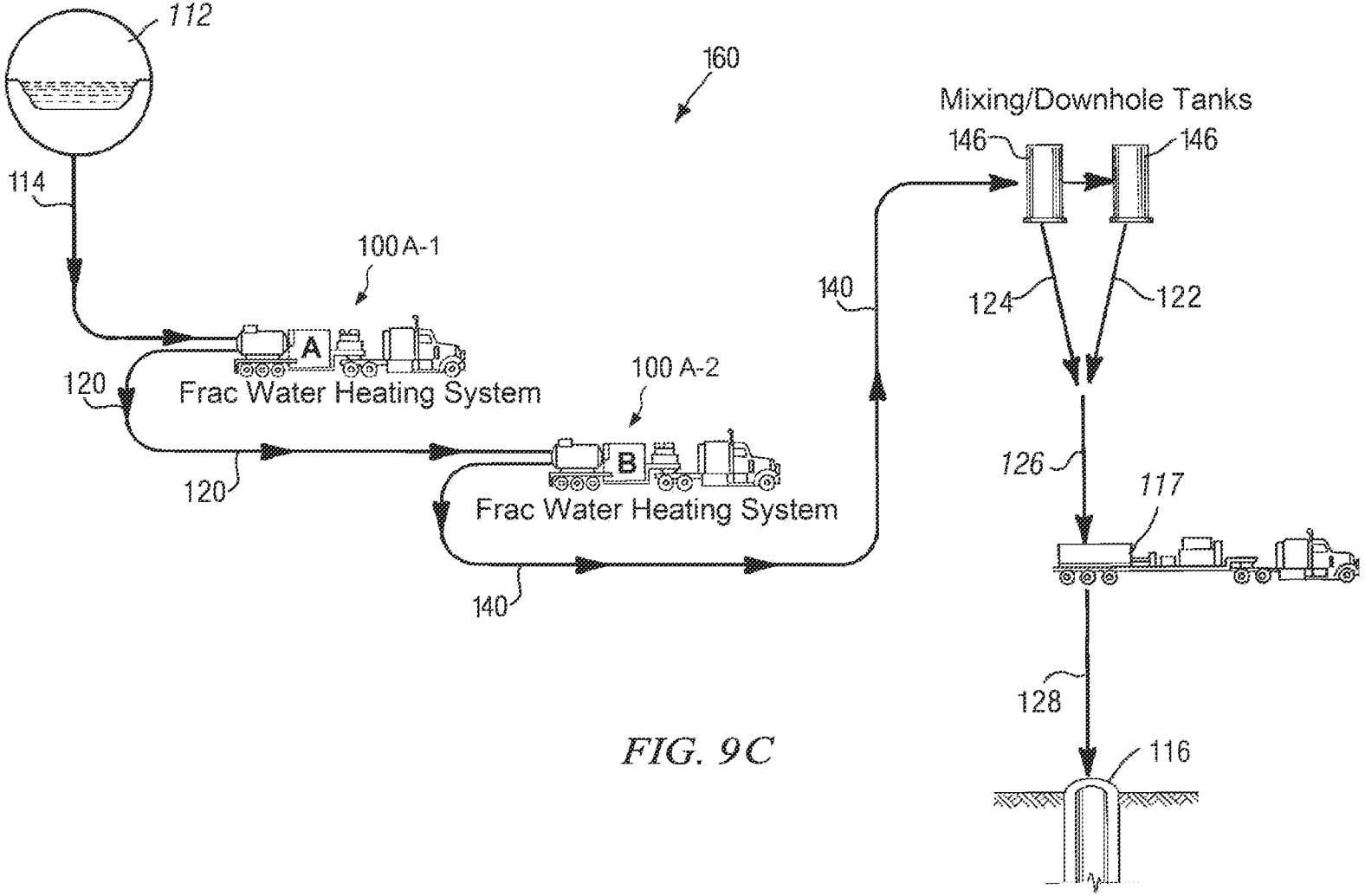
FIG. 9C is a schematic diagram of another alternative embodiment of the method of the present invention.

To achieve greater or higher temperature differentials ($\Delta T$) of the treatment fluid from the source to the well head, multiple frac water heating systems 100A can also be used in tandem with one another. For example, as shown in FIGS. 2D-E and 9C, two or more frac water heating systems 100A are preferably arranged in a tandem or series configuration to heat the treatment fluid from a common source, all of which is done on a continuous flow basis. For example, in the depicted embodiment of the method 160, treatment fluid (e.g., water) from a source 112 flows in supply line 114 to the intake manifold 90 of a first (A) frac water heating system 100A-1, where it proceeds to be heated in accordance with the process of the present invention discussed previously. Upon heating to a first temperature, the heated water from the first frac water heating system 100A-1 is directed via its outlet conduit 95 and manifold 96 to flow line 120, which transfers the warmed water produced by the first frac water heating system 100A-1 to the intake manifold 90 of a second (B) frac water heating system 100A-2, where it proceeds to be heated a second time to the second temperature (i.e., target or goal temperature) in accordance with the process of the present invention discussed previously. Upon heating to the second temperature, the super heated treatment fluid from the second frac water heating system 100A-2 is directed via its outlet conduit 95 and manifold 96 to flow line 140, which transfers the super heated water to the mixing tanks or downhole tanks 146. From that point on, the process 160 is essentially the same as the previously disclosed processes 110, 150.

The mixing tanks 146 can be used to mix any selected chemical and/or proppants with the heated treatment fluid from the multiple frac water heating systems to create a prepared fracking fluid that is ready for use in hydraulic fracturing operations in the well 116. Flow lines 122, 124 and 126 illustrate the transfer of the prepared fracking fluid from mixing tanks or downhole tanks 146 to pumping apparatus 117 and then into the well 116 for use in fracking operations. The moving stream of uniformly heated water can also be piped to surge tank(s) which can be used as a safety buffer between the water flow and the pumping operations, in the case of a mechanical breakdown or operational problems.

It is, of course, understood that a first grouping of frac water heating systems 100A arranged in a tandem configuration can be further configured in-parallel with a second grouping of frac water heating systems 100A, also arranged in a tandem configuration, in order to increase both the flow rate and the $\Delta T$ of the treatment fluid.

While the methods illustrated in FIGS. 9A-9C preferably depict the frac water heating system 100A as having a multiple, single-pass heat exchanger device 50A, it is understood that depending upon the actual operating conditions, a frac water heating system 100 having a single continuous heat exchanger device 50 may also be used in accordance with the operating principles of the disclosed methods.

It will now be evident to those skilled in the art that there has been described herein an improved heat exchanger system for heating large, continuously flowing volumes of treatment fluids at remote locations. Although the invention hereof has been described by way of a preferred embodiment, it will be evident that other adaptations and modifications can be employed without departing from the spirit and scope thereof.

For example, instead of the treatment fluid being water, it could be a petroleum based liquid such as oil for hot oil well treatments. The terms and expressions employed herein have been used as terms of description and not of limitation; and thus, there is no intent of excluding equivalents, but on the contrary it is intended to cover any and all equivalents that may be employed without departing from the spirit and scope of the invention.

I claim:

1. A portable system for heating treatment fluids at a remote work site, comprising:

a closed-bottom firebox having an exhaust stack configured near the top of said firebox;

a heat exchanger device contained within said firebox, said heat exchanger device comprising a plurality of single-pass heat exchanger units arranged in a vertically stacked configuration, wherein each of said heat exchanger units comprises a tubular coil having a single inlet for receiving treatment fluid having a first temperature and a single outlet for discharging heated treatment fluid, said plurality of heat exchanger units comprising a first heat exchanger unit comprising a helical coil oriented about a horizontal axis so as to define a combustion chamber for receiving a substantially horizontal combustion flow, said combustion chamber being substantially enclosed by said helical tubular coil on all but one opened side, and a second heat exchanger unit configured above said first heat exchanger unit, said second heat exchanger unit comprising a plurality of stacked horizontal rows of tubing faked down in a series of reversing loops oriented about a vertical axis;

a fluid supply system including a fluid supply pump in fluid communication through a common inlet conduit with each inlet of said plurality of heat exchanger units;

a plurality of burner assemblies configured in said firebox, each of said burner assemblies comprising a nozzle that projects an atomized fuel-air spray into said combustion chamber though said opened side, which when combusted results in a substantially horizontal combustion flow into said combustion chamber;

a primary air system for supplying a first pressurized air flow to each of said burner assemblies, wherein said primary air system comprises a blower pump fluidly connected to a primary air inlet of each of said plurality of burner assemblies, said blower pump comprising a positive displacement rotary blower; and a secondary air system for supplying a second pressurized air flow to said firebox, wherein said helical tubular coil of said first heat exchanger unit includes a plurality of traversing lateral tubes which substantially enclose said combustion chamber on a side opposing said opened side, wherein at least one of said traversing lateral tubes is configured directly in line with said substantially horizontal combustion flow; and wherein said second pressurized air flow increases the convective heat transfer of thermal energy from said combustion flow to said treatment fluid as said fluid is pumped through its respective heat exchanger unit by said supply pump.

2. The system of claim 1, wherein said plurality of single-pass heat exchanger units further comprises a third heat exchanger unit configured above said second heat exchanger unit, said third heat exchanger unit comprising a plurality of stacked horizontal rows of tubing faked down in a series of reversing loops oriented about the vertical axis.

3. The system of claim 1, wherein each of said plurality of burner assemblies comprise a gas-fired burner assembly.

4. The system of claim 1, wherein each of said plurality of burner assemblies comprise an oil-fired burner assembly.

5. The system of claim 1, wherein each outlet of said plurality of heat exchanger units is fluidly connected to a common outlet conduit.

6. The system of claim 5, further comprising a fuel supply system, which includes a fuel pressure control motor valve that controls the volume of pressurized fuel supplied to each set of burner assemblies.

7. The system of claim 6, wherein said fuel pressure control motor valve is pneumatically actuated.

8. The system of claim 6, further comprising a temperature controller mechanism, which controls the temperature of the treatment fluid exiting said outlet conduit by adjusting a control signal to said fuel pressure control motor valve to increase or decrease the volume of pressurized fuel supplied to each set of burner assemblies.

9. The system of claim 8, wherein said temperature controller mechanism automatically adjusts said control signal in response to a comparison between the temperature of the treatment fluid exiting said outlet conduit and a set point temperature setting on said temperature controller mechanism.

10. The system of claim 9, wherein said temperature controller mechanism senses the temperature of said treatment fluid at said outlet conduit, compares said temperature to a set-point temperature, and adjusts said control signal to said fuel pressure control motor valve to increase or decrease the volume of pressurized fuel supplied to each set of burner assemblies so that said temperature will equal said set-point temperature.

11. The system of claim 1, wherein said firebox includes at least one exterior vent and interior passageway, which supplies ambient air from the upper exterior of the firebox to the front of the burner assemblies.

12. The system of claim 1, wherein said secondary air system comprises a plurality of centrifugal fan mechanisms aligned in a parallel configuration and having a common driveshaft, wherein each of said plurality of centrifugal fan mechanisms includes a housing in fluid communication with ductwork that is fluidly connected to a plurality of vents in said firebox.

13. The system of claim 12, wherein said blower pump is rotatively coupled to said driveshaft.

14. The system of claim 13, wherein the blower pump and said plurality of centrifugal fan mechanisms are powered by a motor attached to said driveshaft.

15. The system of claim 14, wherein said motor is hydraulically powered.

16. The system of claim 1, wherein said plurality of burner assemblies comprises a first and second set of burner assemblies, wherein each set comprises more than one burner assembly;

said primary air system comprises a first primary blower system which includes a first blower pump fluidly connected to a primary air inlet of each of said first set of burner assemblies, and a second primary blower system which includes a second blower pump fluidly connected to a primary air inlet of each of said second set of burner assemblies;

said secondary air system comprises a first secondary blower system which includes a first plurality of centrifugal fan mechanisms aligned in a parallel configuration and having a common first driveshaft, wherein each of said first plurality of centrifugal fan mechanisms includes a housing in fluid communication with a first ductwork that is fluidly connected to a first plurality of vents in said firebox, and a second secondary blower system which includes a second plurality of centrifugal fan mechanisms aligned in a parallel configuration and having a common second driveshaft, wherein each of said second plurality of centrifugal fan mechanisms includes a housing in fluid communication with a second ductwork that is fluidly connected to a second plurality of vents in said firebox;

wherein said first blower pump is rotatively coupled to said first driveshaft and said second blower pump is rotatively coupled to said second driveshaft.

17. The system of claim 16, wherein said first blower pump and said first plurality of centrifugal fan mechanisms are powered by first motor rotatively coupled to said first driveshaft; and said second blower pump and said second plurality of centrifugal fan mechanisms are powered by second motor rotatively coupled to said second driveshaft.

18. The system of claim 1, further including a hood door assembly, which comprises a first door, which is pivotally mounted to one side of said exhaust stack; and a second door, which is pivotally mounted to an opposing side of said exhaust stack.

19. A portable system for heating treatment fluids at a remote work site, comprising:

a closed-bottom firebox having an exhaust stack configured near the top of said firebox;

a heat exchanger device contained within said firebox, said heat exchanger device comprising a plurality of single-pass heat exchanger units arranged in a vertically stacked configuration, wherein each of said heat exchanger units comprises a tubular coil having a single inlet for receiving treatment fluid having a first temperature and a single outlet for discharging heated treatment fluid, said plurality of heat exchanger units comprising a first heat exchanger unit comprising a helical coil oriented about a horizontal axis so as to define a combustion chamber for receiving a substantially horizontal combustion flow, said combustion chamber being substantially enclosed by said helical tubular coil on all but one opened side, and a second heat exchanger unit configured above said first heat exchanger unit, said second heat exchanger unit comprising a plurality of stacked horizontal rows of tubing faked down in a series of reversing loops oriented about a vertical axis;

a fluid supply system including a fluid supply pump in fluid communication through a common inlet conduit with each inlet of said plurality of heat exchanger units;

a plurality of burner assemblies configured in said firebox, each of said burner assemblies comprising a nozzle that projects an atomized fuel-air spray into said combustion chamber though said opened side, which when combusted results in a substantially horizontal combustion flow into said combustion chamber;

a primary air system for supplying a first pressurized air flow to each of said burner assemblies, wherein said primary air system comprises a blower pump fluidly connected to a primary air inlet of each of said plurality of burner assemblies, and an intake air filter in fluid communication with said blower pump; and a secondary air system for supplying a second pressurized air flow to said firebox, wherein said helical tubular coil of said first heat exchanger unit includes a plurality of traversing lateral tubes which substantially enclose said combustion chamber on a side opposing said opened side, wherein at least one of said traversing lateral tubes is configured directly in line with said substantially horizontal combustion flow; and wherein said second pressurized air flow increases the convective heat transfer of thermal energy from said combustion flow to said treatment fluid as said fluid is pumped through its respective heat exchanger unit by said supply pump.

20. A portable system for heating treatment fluids at a remote work site, comprising:

a closed-bottom firebox having an exhaust stack configured near the top of said firebox;

a heat exchanger device contained within said firebox, said heat exchanger device comprising a plurality of single-pass heat exchanger units arranged in a vertically stacked configuration, wherein each of said heat exchanger units comprises a tubular coil having a single inlet for receiving treatment fluid having a first temperature and a single outlet for discharging heated treatment fluid, said plurality of heat exchanger units comprising a first heat exchanger unit comprising a helical coil oriented about a horizontal axis so as to define a combustion chamber for receiving a substantially horizontal combustion flow, said combustion chamber being substantially enclosed by said helical tubular coil on all but one opened side, and a second heat exchanger unit configured above said first heat exchanger unit, said second heat exchanger unit comprising a plurality of stacked horizontal rows of tubing faked down in a series of reversing loops oriented about a vertical axis;

a fluid supply system including a fluid supply pump in fluid communication through a common inlet conduit with each inlet of said plurality of heat exchanger units;

a plurality of burner assemblies configured in said firebox, each of said burner assemblies comprising a nozzle that projects an atomized fuel-air spray into said combustion chamber though said opened side, which when combusted results in a substantially horizontal combustion flow into said combustion chamber;

a primary air system for supplying a first pressurized air flow to each of said burner assemblies, wherein said primary air system comprises a blower pump fluidly connected to a primary air inlet of each of said plurality of burner assemblies, and an air silencer mechanism in fluid communication with said blower pump and said plurality of burner assemblies; and a secondary air system for supplying a second pressurized air flow to said firebox, wherein said helical tubular coil of said first heat exchanger unit includes a plurality of traversing lateral tubes which substantially enclose said combustion chamber on a side opposing said opened side, wherein at least one of said traversing lateral tubes is configured directly in line with said substantially horizontal combustion flow; and wherein said second pressurized air flow increases the convective heat transfer of thermal energy from said combustion flow to said treatment fluid as said fluid is pumped through its respective heat exchanger unit by said supply pump.

* * * * *